US011220810B2

(12) United States Patent
Ball

(10) Patent No.: US 11,220,810 B2
(45) **Date of Patent: *Jan. 11, 2022**

(54) DEVICE AND METHOD FOR CONCEALING A FLANGE OF A WASTE WATER STRAINER

(71) Applicant: WCM Industries, Inc., Colorado Springs, CO (US)

(72) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 29 days.

This patent is subject to a terminal disclaimer.

(21) Appl. No.: 16/817,160

(22) Filed: Mar. 12, 2020

(65) Prior Publication Data

US 2020/0208385 A1 Jul. 2, 2020

Related U.S. Application Data

(60) Continuation of application No. 16/112,144, filed on Aug. 24, 2018, now Pat. No. 10,590,637, which is a continuation of application No. 15/276,384, filed on Sep. 26, 2016, now Pat. No. 10,151,088, which is a continuation of application No. 14/332,148, filed on Jul. 15, 2014, now Pat. No. 9,453,329, which is a (Continued)

(51) Int. Cl.

| | |
|---|---|
| ***E03C 1/262*** | (2006.01) |
| ***E03C 1/26*** | (2006.01) |
| ***A47K 1/14*** | (2006.01) |

(52) U.S. Cl.

CPC ..... *E03C 1/262* (2013.01); *A47K 1/14* (2013.01); *E03C 1/26* (2013.01); *Y10T 29/49826* (2015.01); *Y10T 156/10* (2015.01)

(58) Field of Classification Search

CPC ..... E03C 1/262

USPC ..... 4/286, 256.1, 292, 295, 652, 287, 288, 4/289, 290; 210/348; 241/32.5, 46.016

See application file for complete search history.

(56) References Cited

U.S. PATENT DOCUMENTS

| | | |
|---|---|---|
| 441,099 A | 11/1890 | Hoyt |
| 569,247 A | 10/1896 | Smith |

(Continued)

FOREIGN PATENT DOCUMENTS

| | | |
|---|---|---|
| CA | 530215 | 9/1956 |
| DE | 419477 | 9/1925 |

(Continued)

OTHER PUBLICATIONS

U.S. Appl. No. 29/561,020, dated Apr. 12, 2016, Ball.

(Continued)

*Primary Examiner* — Lori L Baker

(57) ABSTRACT

A device used to conceal at least a portion of a wastewater strainer associated with a bathtub. More specifically, a plate having an opening therethrough is used to overlap a flange of the wastewater strainer wherein the opening in the plate generally coincides with an opening in the wastewater strainer so that the bathtub drain is unobstructed. The plate may include a downwardly extending lip to help facilitate orientation onto the flange of the wastewater strainer. The plate conceals the wastewater strainer, thereby facilitating reconfiguration of a bathtub as the existing wastewater strainer need not be removed and the plumbing system retested.

20 Claims, 28 Drawing Sheets

Related U.S. Application Data division of application No. 13/274,804, filed on Oct. 17, 2011, now Pat. No. 8,813,272.

(60) Provisional application No. 61/524,675, filed on Aug. 17, 2011, provisional application No. 61/394,611, filed on Oct. 19, 2010.

(56) References Cited

U.S. PATENT DOCUMENTS

| | | | |
|---|---|---|---|
| 820,437 | A | 5/1906 | Pehrson |
| 1,059,748 | A | 4/1913 | Mueller et al. |
| 1,592,866 | A | 7/1926 | Murphy |
| 1,805,816 | A | 5/1931 | Fleming |
| 1,852,123 | A | 4/1932 | Lutsky |
| 1,995,474 | A | 3/1935 | Ellis |
| 2,190,532 | A | 2/1940 | Lukomski |
| 2,222,807 | A | 11/1940 | Burr |
| 2,278,566 | A | 4/1942 | Schaible |
| 2,323,224 | A | 6/1943 | Kuhnle |
| 2,389,528 | A | 11/1945 | McConaghy |
| 2,528,919 | A | 11/1950 | Stone et al. |
| D176,281 | S | 12/1955 | Patriquin |
| 2,731,649 | A | 1/1956 | Valentine |
| 2,736,577 | A | 2/1956 | Mackey |
| D180,635 | S | 7/1957 | Arbib et al. |
| 2,800,231 | A | 7/1957 | Hicks |
| 2,890,463 | A | 6/1959 | Young |
| 2,905,951 | A | 9/1959 | Weddendorf, Jr. |
| 2,976,543 | A | 3/1961 | Turner et al. |
| 3,037,212 | A | 6/1962 | Kleinhof |
| 3,046,028 | A | 7/1962 | Nathan |
| 3,048,415 | A | 8/1962 | Shook |
| 3,096,527 | A | 7/1963 | Eynon |
| 3,212,416 | A | 10/1965 | Boersma |
| 3,306,512 | A | 2/1967 | Pagnini |
| 3,311,391 | A | 3/1967 | Harrell |
| 3,316,562 | A | 5/1967 | Van Dyke et al. |
| 3,345,085 | A | 10/1967 | Hanes |
| 3,349,412 | A | 10/1967 | Schwartz et al. |
| 3,380,081 | A | 4/1968 | Eilerstson et al. |
| 3,501,172 | A | 3/1970 | Pickard |
| 3,579,670 | A | 5/1971 | Frank |
| 3,615,984 | A | 10/1971 | Chase |
| 3,684,199 | A | 8/1972 | Bebinger |
| 3,800,339 | A | 4/1974 | Bergin |
| 3,813,708 | A | 6/1974 | Hamburg |
| 3,881,201 | A | 5/1975 | Richards |
| 3,911,635 | A | 10/1975 | Traupe |
| D240,120 | S | 6/1976 | Pasquarette |
| D241,565 | S | 9/1976 | Molenaar |
| 3,982,289 | A | 9/1976 | Robbins |
| 4,032,455 | A | 6/1977 | Kale |
| 4,059,289 | A | 11/1977 | Morris et al. |
| 4,144,599 | A | 3/1979 | Cuschera |
| 4,207,632 | A | 6/1980 | Saveli, Jr. et al. |
| D255,706 | S | 7/1980 | Adam |
| 4,232,407 | A | 11/1980 | Williams |
| 4,257,892 | A | 3/1981 | Boersma |
| 4,310,933 | A | 1/1982 | Stratman |
| 4,320,540 | A | 3/1982 | Leavens |
| 4,329,744 | A | 5/1982 | Cuschera |
| 4,339,832 | A | 7/1982 | Cuschera |
| 4,359,788 | A | 11/1982 | Liou |
| 4,412,361 | A | 11/1983 | Cuschera |
| 4,420,844 | A | 12/1983 | Puckett et al. |
| 4,502,166 | A | 3/1985 | Brown, Sr. |
| 4,505,499 | A | 3/1985 | Uglow et al. |
| 4,571,751 | A | 2/1986 | Barlow |
| 4,574,402 | A | 3/1986 | Brown, Sr. |
| 4,594,740 | A | 6/1986 | Tseronakis |
| 4,655,913 | A | 4/1987 | Boersma |
| 4,683,597 | A | 8/1987 | Taylor et al. |
| 4,692,948 | A | 9/1987 | Martin |
| 4,706,306 | A | 11/1987 | Smith |
| 4,720,877 | A | 1/1988 | Watts |
| 4,799,713 | A | 1/1989 | Uglow |
| 4,850,617 | A | 7/1989 | Moberly |
| 4,908,883 | A | 3/1990 | Rivera |
| 4,926,507 | A | 5/1990 | Craig et al. |
| 5,072,461 | A | 12/1991 | Logsdon |
| D326,456 | S | 5/1992 | Hahn |
| 5,150,886 | A | 9/1992 | Hamberg |
| 5,165,118 | A | 11/1992 | Cendrowski |
| D337,511 | S | 7/1993 | Donaldson |
| D341,390 | S | 11/1993 | Nottingham et al. |
| 5,265,281 | A | 11/1993 | McAlpine |
| 5,271,108 | A | 12/1993 | Wicke |
| 5,291,619 | A | 3/1994 | Adorjan |
| 5,297,817 | A | 3/1994 | Hodges |
| 5,318,230 | A | 6/1994 | Ferguson et al. |
| 5,330,811 | A | 7/1994 | Buchalter |
| D353,847 | S | 12/1994 | Keisen |
| 5,369,815 | A | 12/1994 | Martin |
| 5,372,715 | A | 12/1994 | Maggard et al. |
| 5,376,264 | A | 12/1994 | Betancourt |
| 5,418,983 | A | 5/1995 | Garguillo et al. |
| 5,442,819 | A | 8/1995 | Penor et al. |
| D364,108 | S | 11/1995 | DeWitt |
| D367,622 | S | 3/1996 | DeWitt |
| D367,623 | S | 3/1996 | DeWitt |
| D371,958 | S | 7/1996 | Keaton |
| 5,535,455 | A | 7/1996 | Liu |
| 5,560,052 | A | 10/1996 | Ferguson et al. |
| D379,403 | S | 5/1997 | Jones |
| 5,692,248 | A | 12/1997 | Ball |
| 5,745,931 | A | 5/1998 | Ball |
| 5,758,368 | A | 6/1998 | Ball |
| 5,819,328 | A | 10/1998 | Lewis |
| D402,354 | S | 12/1998 | Strong et al. |
| 5,881,397 | A | 3/1999 | Hobbs |
| 5,890,241 | A | 4/1999 | Ball |
| 5,924,635 | A | 7/1999 | Koshimizu et al. |
| D413,377 | S | 8/1999 | Pauly |
| 5,937,450 | A | 8/1999 | Jones |
| 6,058,526 | A | 5/2000 | Parisi et al. |
| 6,066,119 | A | 5/2000 | Ball |
| 6,067,669 | A | 5/2000 | Peterson et al. |
| 6,070,910 | A | 6/2000 | Hodges |
| 6,085,362 | A | 7/2000 | Huber |
| 6,088,843 | A | 7/2000 | Francisco |
| 6,108,828 | A | 8/2000 | Cheng |
| 6,128,788 | A | 10/2000 | Yamazaki |
| 6,138,290 | A | 10/2000 | Lin |
| 6,148,454 | A | 11/2000 | Ball |
| 6,154,898 | A | 12/2000 | Ball |
| 6,173,459 | B1 | 1/2001 | Ball |
| 6,195,819 | B1 | 3/2001 | Wang |
| 6,226,806 | B1 | 5/2001 | Ball |
| 6,247,989 | B1 | 6/2001 | Neff |
| 6,269,495 | B1 | 8/2001 | Sondrup |
| D448,622 | S | 10/2001 | Horvat |
| 6,317,906 | B1 | 11/2001 | Ball |
| 6,332,632 | B1 | 12/2001 | Hodges |
| 6,418,570 | B1 | 7/2002 | Ball |
| 6,490,739 | B1 | 12/2002 | Lee |
| 6,546,573 | B1 | 4/2003 | Ball |
| D475,130 | S | 5/2003 | Stout, Jr. |
| 6,631,623 | B1 | 10/2003 | Ball |
| 6,637,050 | B1 | 10/2003 | Ball |
| 6,640,358 | B2 | 11/2003 | Ball |
| 6,675,406 | B2 | 1/2004 | Ball |
| 6,675,407 | B1 | 1/2004 | Ball |
| 6,681,420 | B1 | 1/2004 | Ball |
| 6,691,411 | B2 | 2/2004 | Ball |
| D488,217 | S | 4/2004 | Stout, Jr. |
| 6,719,294 | B2 | 4/2004 | Nguyen et al. |
| 6,735,791 | B1 | 5/2004 | Lordahl et al. |
| D494,670 | S | 8/2004 | Snyder |
| 6,789,275 | B2 | 9/2004 | Spells, Sr. et al. |
| 6,795,987 | B2 | 9/2004 | Cornwall |
| 6,799,606 | B1 | 10/2004 | Howson |
| 6,800,024 | B1 | 10/2004 | Prevost |
| 6,880,179 | B2 | 4/2005 | Wang |

(56) References Cited

U.S. PATENT DOCUMENTS

| | | | |
|---|---|---|---|
| 6,895,838 | B2 | 5/2005 | Stahnke |
| D509,994 | S | 9/2005 | Hadland |
| 6,957,452 | B2 | 10/2005 | Grant |
| 7,013,500 | B1 | 3/2006 | Lin |
| 7,055,184 | B2 | 6/2006 | Humber |
| 7,127,752 | B2 | 10/2006 | Ball |
| D532,684 | S | 11/2006 | Barnes |
| 7,188,376 | B2 | 3/2007 | Ortiz et al. |
| D550,204 | S | 9/2007 | Kaneda |
| D563,529 | S | 3/2008 | Labonte |
| D573,235 | S | 7/2008 | Downey |
| D574,066 | S | 7/2008 | Hanna |
| 7,451,502 | B2 | 11/2008 | Ball |
| D586,780 | S | 2/2009 | Skurdal |
| 7,503,083 | B2 | 3/2009 | Ball |
| D607,437 | S | 1/2010 | Kamo |
| 7,740,197 | B1 | 6/2010 | Schulz |
| 7,814,580 | B2 | 10/2010 | Coronado et al. |
| 8,011,030 | B2 | 9/2011 | Li |
| D658,451 | S | 5/2012 | Jost |
| D670,362 | S | 11/2012 | Eylon |
| D670,794 | S | 11/2012 | Antoniello |
| 8,307,469 | B1 | 11/2012 | Cohen |
| 8,336,132 | B2 | 12/2012 | Ball |
| 8,347,906 | B1 | 1/2013 | Ismert et al. |
| 8,607,376 | B2 | 12/2013 | Ball |
| D698,739 | S | 2/2014 | Kleinschmidt |
| D699,819 | S | 2/2014 | Tung |
| 8,813,272 | B2 | 8/2014 | Ball |
| 8,925,123 | B2 | 1/2015 | DeGooyer et al. |
| 9,015,870 | B2 | 4/2015 | Ball |
| 9,015,876 | B2 | 4/2015 | Ball |
| D733,263 | S | 6/2015 | Fujii et al. |
| D746,955 | S | 1/2016 | Corder |
| 9,234,337 | B2 | 1/2016 | Ball et al. |
| D756,715 | S | 5/2016 | Ricciardi |
| D761,398 | S | 7/2016 | Murphy |
| 9,394,678 | B1 | 7/2016 | Macyko |
| 9,453,329 | B2 | 9/2016 | Ball |
| D769,202 | S | 10/2016 | Jung |
| D770,415 | S | 11/2016 | Pellisari |
| D773,331 | S | 12/2016 | Wang |
| D783,167 | S | 4/2017 | Falkenberg |
| D787,023 | S | 5/2017 | Ball |
| D787,024 | S | 5/2017 | Ball |
| D792,743 | S | 7/2017 | Joseph |
| D792,745 | S | 7/2017 | Wu |
| D822,004 | S | 7/2018 | Tan |
| 10,151,088 | B2 | 12/2018 | Ball |
| D844,758 | S | 4/2019 | Ball |
| D856,495 | S | 8/2019 | Ball |
| 10,590,637 | B2 | 3/2020 | Ball |
| 2002/0023294 | A1 | 2/2002 | Spells, Sr. |
| 2002/0112285 | A1 | 8/2002 | Minnick |
| 2003/0025275 | A1 | 2/2003 | Miller |
| 2003/0182721 | A1 | 10/2003 | Li |
| 2004/0117907 | A1 | 6/2004 | Ball |
| 2004/0163165 | A1 | 8/2004 | Ortiz et al. |
| 2005/0035558 | A1 | 2/2005 | Dipzinski et al. |
| 2005/0050623 | A1 | 3/2005 | Greene |
| 2005/0108814 | A1 | 5/2005 | Thompson |
| 2005/0204462 | A1 | 9/2005 | Cotton et al. |
| 2006/0170208 | A1 | 8/2006 | Arning et al. |
| 2006/0207003 | A1 | 9/2006 | Harmes |
| 2006/0283792 | A1 | 12/2006 | McCallum |
| 2007/0039098 | A1 | 2/2007 | Ball |
| 2007/0044231 | A1 | 3/2007 | Ball |
| 2008/0047060 | A1 | 2/2008 | Ball |
| 2008/0072387 | A1 | 3/2008 | Dombrowski |
| 2008/0098504 | A1 | 5/2008 | Knox et al. |
| 2008/0098517 | A1 | 5/2008 | Ball |
| 2008/0148469 | A1 | 6/2008 | Dipzinski et al. |
| 2008/0196161 | A1 | 8/2008 | Ball |
| 2009/0119826 | A1 | 5/2009 | Coronado |
| 2009/0172870 | A1 | 7/2009 | Hong |
| 2009/0172877 | A1 | 7/2009 | Ball |
| 2010/0037392 | A1 | 2/2010 | Ball et al. |
| 2010/0269913 | A1 | 10/2010 | Hollinger |
| 2011/0035867 | A1 | 2/2011 | Coronado et al. |
| 2011/0173747 | A1 | 7/2011 | Evans et al. |
| 2011/0289667 | A1 | 12/2011 | Oropallo et al. |
| 2012/0048070 | A1 | 3/2012 | Richter |
| 2012/0090084 | A1 | 4/2012 | Ball |
| 2012/0110722 | A1 | 5/2012 | Abbondanzio et al. |
| 2012/0199215 | A1 | 8/2012 | Cohen |
| 2013/0055494 | A1 | 3/2013 | Ball |
| 2013/0067648 | A1 | 3/2013 | Whitehead |
| 2013/0193042 | A1 | 8/2013 | Hull |
| 2013/0220455 | A1 | 8/2013 | Lin |
| 2014/0138297 | A1 | 5/2014 | Hull |
| 2014/0259386 | A1 | 9/2014 | Antoniello |
| 2014/0263002 | A1 | 9/2014 | Antoniello |
| 2014/0325748 | A1 | 11/2014 | Ball |
| 2015/0074891 | A1 | 3/2015 | Ychie |
| 2017/0009439 | A1 | 1/2017 | Ball |
| 2018/0363280 | A1 | 12/2018 | Ball |

FOREIGN PATENT DOCUMENTS

| | | |
|---|---|---|
| DE | 1784266 | 10/1971 |
| DE | 3621715 | 1/1988 |
| DE | 9200488 | 3/1992 |
| DE | 4206903 | 9/1993 |
| DE | 20118252 | 3/2003 |
| GB | 1216285 | 12/1970 |
| JP | S53-58752 | 5/1978 |
| JP | H05-15887 | 3/1993 |
| JP | H05-88393 | 12/1993 |
| JP | H09-108130 | 4/1997 |
| JP | 2000-513421 | 10/2000 |
| JP | 2003-313913 | 11/2003 |
| WO | 99/54560 | 10/1999 |
| WO | 02/063109 | 8/2002 |
| WO | 2004/074587 | 9/2004 |
| WO | 2009/063334 | 5/2009 |
| WO | 2013/112560 | 8/2013 |

OTHER PUBLICATIONS

U.S. Appl. No. 29/561,022, dated Apr. 12, 2016, Ball.

U.S. Appl. No. 29/599,494, dated Apr. 4, 2017, Ball.

U.S. Appl. No. 29/599,496, dated Apr. 4, 2017, Ball.

"OATEY*SCS* Supply Chain Services Catalog," Oatey Co., 2012, 334 pages.

"PRESS-IN" Trim Kit, AB&A™ IPS Corporation (date unknown) 2 pages.

"Push N' Repair Closet Flange," IPS Corporation, 2011, [retrieved Sep. 6, 2014], 1 page. Retrieved from: http://web.archive.org/web/20111013024522/http://ipscorp.com/watertite/closetflanges/pushnrepair.

Canadian Examiner's Report for Canadian Application No. 2,556,523, dated Feb. 16, 2009.

Canadian Office Action in Application 2769082, dated Nov. 1, 2018, 4 pages.

Complaint for Delaratory Relief (with Exhibits 1-7), *IPS Corporation* v. *WCM Industries, Inc.,* United States District Court for the Western District of Tennessee, Case No. 2:12-cv-02694, filed Aug. 9, 2012, 58 pages.

DANCO Strainer, https://www.amazon.com/Clip-Style-Shower-Strainer-Chrome-88923/dp/B000FK9SN0/ref=pd_sbs_60_40?encoding=UTF8&pd_rd_i B000FK9SN0&pd_rd_r=0b662d83-a97a-11e8-ab28-01ad97aa66bb&pd_rd_w=sDEZf&pd_rd_wg=MGp2j&pf_rd_i =desktop-dp-sims&pf_rd_m=ATVPDKIKX0DER&pf_rd_p=0bb14103-7f67-4c21-9b0b-31f42dc047e7&pf_rd_r=J13BTFGDN2E1H3G416Q4&pf_rd_s=desktop-dp-sims&pf_rd_t=40701&psc=1&refRID=J13BTFGDN2E1H3G416Q4, (Year: 2006), 8 pages.

Defendant WCM Industries, Inc's Answer To Complaint, Affirmative Defenses and Counterclaims Against IPS Corporation, *IPS Corporation* v. *WCM Industries, Inc.,* United States District Court

(56) References Cited

OTHER PUBLICATIONS for the Western District of Tennessee, Case No. 2:12-cv-02694-JPM-tmp, filed Apr. 12, 2013, 10 pages.
Final Action for U.S. Appl. No. 14/109,503, dated Dec. 29, 2014, 10 pages.
Great Britain Examination and Search Report for United Kingdom Patent Application No. GB1118043.7, dated Oct. 31, 2011 6 pages.
IPS Corporation's Initial Non-Infringement Contentions (with Exhibit A), *IPS Corporation* v. *WCM Industries, Inc.,* United States District Court for the Western District of Tennessee, Case No. 2:12-cv-02694-JPM-dkv, dated Jun. 7, 2013, 5 pages.
Mexican Official Action (with partial English summary) for Mexican Patent Application No. MX/a/2012/002782 dated Dec. 1, 2014, 3 pages.
Mexican Official Action for Mexican Patent Application No. MX/a/2012/002782 dated Jun. 3, 2014, 4 pages.
Moen, 101663BNMOENF Kingsley 4- 1/4-Inch Snap-In Shower Drain Cover, https://www.amazon.com/dp/B00083QIL4/ref=psdc_6808091011_t5_B001 DU58LW?th=1, Date First Available Apr. 4, 2008, [Visited Online Aug. 26, 2018], (Year: 2008), 9 pages.
Notice of Allowance for U.S. Appl. No. 13/041,929 dated Feb. 11, 2015, 7 pages.
Notice of Allowance for U.S. Appl. No. 13/274,804 dated Apr. 23, 2014, 6 pages.
Notice of Allowance for U.S. Appl. No. 13/669,417 dated Sep. 27, 2013, 9 pages.
Notice of Allowance for U.S. Appl. No. 14/109,503, dated Mar. 11, 2015 8 pages.
Notice of Allowance for U.S. Appl. No. 14/332,148 dated Aug. 4, 2016, 7 pages.
Notice of Allowance for U.S. Appl. No. 29/561,020 dated Feb. 15, 2017, 8 pages.
Notice of Allowance for U.S. Appl. No. 29/561,022 dated Feb. 17, 2017, 8 pages.
Notice of Allowance for U.S. Appl. No. 11/161,933, dated Jan. 29, 2009, 6 pages.
Official Action for U.S. Appl. No. 12/405,956, dated Oct. 14, 2010, 8 pages.
Official Action for U.S. Appl. No. 13/041,929 dated Dec. 18, 2013, 6 pages. (restriction requirement).
Official Action for U.S. Appl. No. 13/041,929 dated May 8, 2014, 12 pages.
Official Action for U.S. Appl. No. 13/274,804 dated Dec. 24, 2013, 10 pages.
Official Action for U.S. Appl. No. 13/669,417 dated Mar. 1, 2013, 7 pages.
Official Action for U.S. Appl. No. 13/912,421, dated Jun. 18, 2015 9 pages.
Official Action for U.S. Appl. No. 14/109,503 dated Aug. 18, 2014, 6 pages.
Official Action for U.S. Appl. No. 14/332,148 dated Apr. 5, 2016, 6 pages.
Official Action for U.S. Appl. No. 11/161,933, dated Jun. 23, 2008, 6 pages.
Plaintiff IPS Corporation's Answer To Defendant WCM Industries, Inc's Counterclaims, *IPS Corporation* v. *WCM Industries, Inc.,* United States District Court for the Western District of Tennessee, Case No. 2:12-cv-02694-JPM-tmp, filed May 3, 2013, 5 pages.
Plaintiff IPS's Initial Invalidity Contentions (with Exhibits A and B), *IPS Corporation* v. *WCM Industries, Inc.,* United States District Court for the Western District of Tennessee, Case No. 2:12-cv-02694-JPM-dkv, dated Aug. 6, 2013, 78 pages.
Shower Strainee, 20 second mark of Youtube Video, YOUTUBE, at Frame 0:20 of 0:43, https://www.youtube.com/watch?v=K4HHOX4kW8c, Published Feb. 9, 2011, [Visited Online Aug. 26, 2018] (Year: 2011), 2 pages.
U.S. Appl. No. 13/041,929, Notice of Allowance dated Mar. 11, 2015, 4 pages.
U.S. Appl. No. 13/041,929, Notice of Allowance dated Mar. 31, 2015, 4 pages.
U.S. Appl. No. 13/669,417, Notice of Allowance dated Nov. 15, 2013, 5 pages.
U.S. Appl. No. 13/912,421, Notice of Allowance dated Oct. 1, 2015, 6 pages.
U.S. Appl. No. 15/276,384, Notice of Allowance dated Oct. 1, 2018, 9 pages.
U.S. Appl. No. 15/276,384, Notice of Allowance dated May 21, 2018, 6 pages.
U.S. Appl. No. 15/276,384, Office Action dated Dec. 12, 2017, 7 pages.
U.S. Appl. No. 15/276,384, Office Action dated Mar. 15, 2018, 6 pages.
U.S. Appl. No. 29/599,494, Office Action dated Feb. 22, 2018, 9 pages.
U.S. Appl. No. 29/599,494, Office Action dated Aug. 31, 2018, 7 pages.
U.S. Appl. No. 29/599,496, Notice of Allowance dated Nov. 7, 2018, 7 pages.
U.S. Appl. No. 29/599,496, Office Action dated Jan. 29, 2018, 7 pages.
U.S. Appl. No. 29/599,496, Office Action dated May 25, 2018, 12 pages.
U.S. Appl. No. 29/599,494, Notice of Allowance dated Mar. 19, 2019, 8 pages.
Atlas Sound FA51-4.4 Inch Round Grille Strategy Speakers, Pro Acoustics, https://web.archive.org/web/*/https://www.proacousticsusa.com/commercial-sound-equipment/commercial-sound-accessories/speaker-grills/atlas-sound-fa51-4-4-inch-round-grille-for-strategy-speakers.html, 2 pages. (Year: 2017).
U.S. Appl. No. 16/112,144, Office Action dated Aug. 7, 2019, 7 pages.
U.S. Appl. No. 16/112,144, Notice of Allowance dated Nov. 6, 2019, 6 pages.

DEVICE AND METHOD FOR CONCEALING A FLANGE OF A WASTE WATER STRAINER

This application is a continuation of U.S. patent application Ser. No. 16/112,144, filed Aug. 24, 2018, which is a continuation of U.S. patent application Ser. No. 15/276,384, filed Sep. 26, 2016, now U.S. Pat. No. 10,151,088, which is a continuation of U.S. patent application Ser. No. 14/332,148, filed Jul. 15, 2014, now U.S. Pat. No. 9,453,329, which is a divisional of U.S. patent application Ser. No. 13/274,804, filed Oct. 17, 2011, now U.S. Pat. No. 8,813,272, which claims the benefit of U.S. patent application Ser. No. 61/394,611, filed Oct. 19, 2010, and Ser. No. 61/524,675, filed Aug. 17, 2011, both entitled "Device and Method for Concealing a Flange of a Wastewater Strainer," the entire disclosures of which are incorporated by reference herein. Applicant also incorporates by reference herein U.S. Pat. No. 9,234,337, entitled "Foot-Actuated Drain Stopper," which was filed on Jun. 7, 2013. To the extent appropriate a claim for priority is made to each of the preceding applications.

FIELD OF THE INVENTION

Embodiments of the present invention are generally related to a device that alleviates the need to replace a damaged or outdated wastewater strainer. More specifically, a universal device for covering and concealing a flange of an existing waste water strainer.

BACKGROUND OF THE INVENTION

Water receptacles, such as bathtubs, generally include a drain port located at their lowermost point. The drain port is interconnected to a drain pipe and receives a strainer that prevents items from entering the drain pipe. A "strainer," as appreciated by one of skill in the art is the threaded fitting located in the bottom of a sink, bathtub, or the like (hereinafter "bathtub") through which wastewater flows. Commonly, strainers have an externally threaded cylindrical portion that engages corresponding threads of the drain port and/or the drain pipe. The strainer also includes a flange, which extends from the upper end of the cylindrical portion, that engages the bottom of the bathtub. The flange sometimes rests in an indentation provided in the bottom of the bathtub. Strainers usually include closure valves that selectively control the flow of water therethrough. The closure valve is often interconnected to the strainer by way of a carrier that extends upwardly from a hub located within the cylindrical portion. The distance between the flange and the hub varies depending on the type of closure valve employed.

Strainer flanges may become outdated, damaged, or marred. In addition, individuals may simply wish to change the look and feel of their bathroom by changing the plumbing fixtures. For example, one may wish to replace brushed-nickel fixtures to brass fixtures. Replacement, however, is often very difficult because the strainer must be disconnected from the drain pipe, which is difficult to access because it is often located beneath the floor to which the bathtub is interconnected. Further, the threads of the replacement strainer may not be compatible with the threads of the drain port and/or drain pipe.

Wastewater strainers are presently concealed by devices that are glued to or otherwise interconnected to the wastewater strainer. That is, instead of replacing the wastewater strainer, a concealing member of the intended finish is placed on the flange of the existing strainer. For example, attention is directed to Applicant's Nufit™ device, which is disclosed in U.S. Pat. No. 5,745,931, that employs a flange that is glued onto the strainer flange. The Nufit™ flange includes a downwardly-extending outer lip that engages the outer edge of the wastewater strainer flange that, alone or in concert with other features, helps maintain radial position of the Nufit™ device with respect to the strainer. The Nufit™ device also employs a cylindrical portion that is placed within the cylindrical member of the wastewater strainer.

Another device is described in U.S. Pat. No. 7,503,083 (the "'083 patent") that is similar to that of the Nufit™ device wherein a flange is provided with a cylindrical portion extending therefrom. The cylindrical portion also includes at least one groove for receiving an o-ring seal that engages the cylindrical member of the wastewater strainer to maintain the position of the concealing device. The o-ring seal helps align the opening of the strainer and the concealing device. It should be noted that the device of the '083 patent contemplates a system wherein no adhesives are used. The outer edge of the '083 device may also include a downwardly extending outer lip for engaging the outer edge of the waste water flange similar to that described above.

One drawback of the prior art devices is that the downwardly-extending cylindrical portion that is often employed may interfere with internal components of the strainer, which prevent engagement of the strainer flange and the concealing device flange. More specifically, strainers usually possess spokes or cross members that accommodate the hub that holds the closure valve carrier. Further, there are a multitude of strainer manufacturers, each with different designs, sizes, features, etc. In addition, manufacturers may, over time, modify designs such that retrofitting existing systems may prove problematic. The interference between the concealing device and the strainer frustrates consumers and forces them to either alter the cylindrical portion of the concealing device, i.e. trim it, or to purchase a new one. As trivial as this may at first appear, the practical consequences of such difficulties has serious financial implications. For example, a $500 per night hotel room may remain vacant simply due to the inability to conceal a damaged bathtub fixture. The foreseeable cost caused by the failure to have a straightforward "one size fits all" solution is enormous and orders of magnitude above the cost of the product itself.

Thus, it has been a long felt but unsolved need to provide a device for concealing a wastewater strainer in lieu of replacing it that is easy to install and can accommodate various models of wastewater strainers.

SUMMARY OF THE INVENTION

It is one aspect of the present invention to provide a device for concealing at least a portion of a wastewater strainer that is associated with a drain port of a bathtub. One embodiment of the present invention includes a plate with an aperture therethrough and an outer edge that generally coincides with an outer edge of the wastewater strainer. The plate can be any thickness and made of any material so long as it conceals at least a portion, and more preferably the majority of a flange of the wastewater strainer. One embodiment of the present invention is about 0.020 inches thick. Some plates of embodiments of the present invention possess a downwardly extending outer lip that interacts with an outer edge of the wastewater strainer flange to maintain the orientation of the plate with respect to the wastewater strainer flange.

Certain embodiments of the present invention have no portion that extends substantially into the wastewater strainer, thereby making them suitable for use with all types of wastewater strainers. Some embodiments, however, have portions that extend into the strainer to such a degree to not affect interconnection of the concealing device to the strainer. For example, a series of spaced tabs may be selectively interconnected adjacent to the inner diameter of the plate that is defined by the aperture. The tabs extend into the strainer body similar to inserts of the prior art. The tabs are spaced such that the cross members of the strainer are received in the spaces, thereby allowing the device to accommodate strainers of various sizes. One of skill in the art will appreciate that the tabs may be frangible to decrease the length thereof or completely removable from the plate. The tabs of some embodiments extend 2 centimeters from the plate, 1 cm from the plate, or 0.5 cm from the plate. The tabs may also be made to split longitudinally to decrease the width thereof and to increase the gap between adjacent tabs, if necessary.

Other embodiments enhance alignment of the concealing device with the strainer body by providing a flexible or compressible screen segment interconnected to the plate that extends into the strainer body. The screen will compress when contacting the cross members and may also include a plurality of openings that allow fluid flow through the walls thereof. The flexible material may also be cut to accommodate strainers of various sizes.

Similarly, the plate may employ additional features to enhance alignment. For example, a series of grooves or small projections may extend from the underside of the plate to help align the plate on strainer flanges of various diameters.

It is thus another aspect of the present invention to provide a device for concealing a wastewater strainer wherein substantially no portion thereof is located within the wastewater strainer. In order to accommodate a stopper, which maintains fluid within the bathtub and controls the release of fluid from the bathtub, one embodiment of the present invention includes a plurality of arms that extend into an opening of the plate. The arms terminate at a hub that accommodates a stopper-receiving carrier that extends above the plate. More specifically, lift and turn mechanisms, as taught by U.S. Pat. No. 5,758,368, Presflo™ stopper mechanism, as taught by U.S. Pat. No. 6,066,119; and push/pull stoppers as taught by U.S. Pat. No. 6,418,570, may be used with embodiments of the present invention. These patents are incorporated by reference in their entirety herein. One of skill in the art will appreciate that the arms may be omitted where, for example, the stopper is operatively interconnected to a carrier or a stopper that is associated directly with the strainer body It is another aspect of the present invention to provide a device and method for concealing a wastewater strainer that employs an adapter that is selectively interconnectable to the plate. The adapter is interconnected to the plate, preferably to the arms thereof, and is designed to extend downwardly into the wastewater strainer. This embodiment will thus allow for greater stability between the plate and the wastewater strainer. It is contemplated that the adapter will accommodate strainers of various sizes or correspond to a specific strainer. The adapter of one embodiment of the present invention also includes at least one groove for receiving an o-ring that helps interconnect the adapter to the cylindrical wall of the wastewater strainer. It is also contemplated that the device for concealing may be sold or accompanied by with the adapter wherein if an interference between the adapter and the wastewater strainer was apparent, the adapter could be removed.

In operation of one embodiment, the plate is superimposed over the flange of a conventional wastewater strainer located in the bathtub. If present, the downwardly extending edge associated with the outer edge of the plate is used to align the plate on to the flange of the wastewater strainer. Other embodiments of the present invention have alternative physical features for contacting the outer edge of the strainer flange. Such contacting portions may be grooves, that are preferably circular, that correspond to and engage with the outer edge of the strainer flange.

An adhesive material may be placed between the plate and the strainer flange and provides one of, if not the sole means of attachment between the plate and the strainer. The bottom portion of the plate may include a roughened or otherwise non-continuous surface to help facilitate binding adhesive. The roughened surface may include text or other indicia to identify the origin of the product.

Alternatively, the plate may include adhesive and associated substrate incorporated onto its lower surface. In operation, the installer would remove a thickness of substrate and associated adhesive so that the thickness of the strainer body is accommodated, i.e., such that the concealing device does not extend too far from the bottom surface of the bathtub. The remaining portions of the adhesive and substrate remain associated with the plate and are used to bond the concealing member to the strainer flange. To facilitate bonding, the adhesive may be heat sensitive such that exposure of hot water will initiate cure and create a permanent bond between the plate and the strainer. One skilled in the art will appreciate that magnets may also be employed to interconnect the plate to the strainer body. To this end, the strainer flange may receive a ferromagnetic material that would bond with a magnet associated with the concealing device.

It is another aspect of the present invention to provide a device adapted for concealing a flange of a wastewater strainer comprising: a plate having an outer edge and an opening therethrough, said opening defining an inner edge; a first arm having a first end interconnected to said inner edge and a second end interconnected to a hub positioned in the center of said opening; a second arm having a first end interconnected to said inner edge and a second end interconnected to said hub; a carrier associated with said hub and extending from said plate; and wherein said plate is adapted to be associated with the flange of the wastewater strainer at least partially concealing the same.

It is another aspect of the present invention to provide a device adapted for concealing a portion of a wastewater strainer comprising: a plate having an outer edge and an opening therethrough; an arm associated with said plate and extending into said opening; a hub positioned within said opening and associated with said arm; and a carrier associated with said hub and extending from said plate.

It is still yet another aspect of the present invention to provide a member adapted for interconnection with a flange of a wastewater strainer for concealing the same, the wastewater strainer including a cylindrical wall extending from the flange, the cylindrical wall positioned in a drain port of a bathtub, the member comprising an outer edge that generally coincides with an outer edge of the strainer flange and having an opening that coincides with an opening in the wastewater strainer defined by the cylindrical wall thereof, the improvement comprising: a first arm associated with said member having a first end interconnected to a hub located in said opening of said member; a second arm associated with said member having a first end interconnected to said member and a second edge interconnected to said hub; a carrier associated with said hub and extending from said plate; and wherein no portion of said member said first arm, said second arm and said carrier extend below said flange of the wastewater strainer and into the cylindrical wall thereof when said member is interconnected to said wastewater strainer.

It is a further aspect of the present invention to provide in combination a fluid compartment having a bottom surface with a wastewater strainer associated with said bottom surface, said strainer having a cylindrical wall surrounding a cylindrical opening extending through said bottom surface of said fluid compartment, and a strainer flange extending outwardly from said cylindrical opening and positioned on said bottom surface of said fluid compartment, a plate having an outer diameter approximately the same as the diameter of said strainer flange and an aperture therethrough, said plate resting on said strainer flange with an adhesive material therebetween wherein said aperture and said cylindrical opening generally coincide; at least one arm associated with said plate and extending into said aperture; a hub associated with said at least one arm; and a carrier extending from said hub.

It is still yet another aspect of the present invention to provide a method of concealing a flange of a wastewater strainer that is positioned in a fluid receptacle, comprising: providing a plate with an outer edge that generally corresponds with an outer edge of said flange; and interconnecting said plate to said flange of said wastewater flange, wherein no portion of said plate is positioned within said wastewater strainer.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
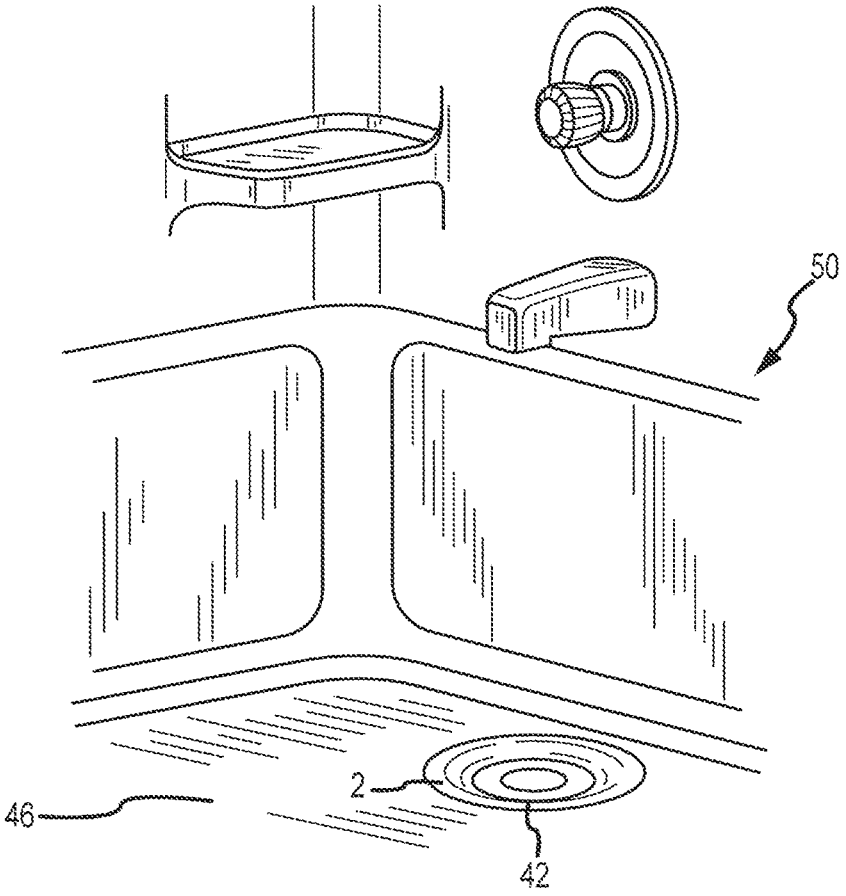
FIG. 1 is a perspective view of a wastewater strainer positioned in a bathtub.

To assist in the understanding of one embodiment of the present invention the following list of components and associated numbering found in the drawings is provided herein:

| # | Component |
|---|---|
| 2 | Concealing device |
| 6 | Plate |
| 10 | Opening |
| 14 | Arms |
| 18 | Hub |
| 22 | Carrier |
| 26 | Stopper |
| 30 | Outer edge |
| 34 | Outer edge |
| 38 | Flange |
| 42 | Wastewater strainer |
| 46 | Bottom surface |
| 50 | Bathtub |
| 54 | Lip |
| 62 | Opening |
| 64 | Sealant |
| 66 | Stopper body |
| 70 | Gasket |
| 74 | Knob |
| 78 | Cavity |
| 82 | Adapter |
| 86 | Seal groove |
| 90 | Clip |
| 94 | Conduit |
| 98 | Tape |
| 102 | Ring |
| 106 | Adhesive sheet |
| 110 | Tabs |
| 114 | Score line |
| 118 | Bellows |
| 122 | Stopper |
| 126 | Chain |
| 130 | PEM insert |
| 134 | Centering dome |
| 138 | Carrier |
| 142 | Guide member |
| 143 | Detent |
| 144 | Guide path |
| 146 | Stopper body |
| 150 | Seal |
| 154 | Friction ring |
| 158 | Ring follower |
| 164 | Cap |
| 168 | Spring |
| 174 | Connector |
| 178 | Bolt |
| 182 | First end |
| 186 | Second end |
| 190 | Hub |
| 194 | Spokes |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIGS. 1-12, a wastewater strainer concealing device 2 of one embodiment of the present invention is shown. The concealing device 2 is generally comprised of a plate 6 with an opening 10 therethrough. A plurality of arms 14 is associated with the plate 6 that extend into the opening 10 and terminate at a hub 18. Although two arms are shown, one of skill in the art will appreciate that one or more arms may be provided. The hub 18 in turn accommodates an upwardly extending carrier 22 that receives a drain stopper 26. The hub 18 of one embodiment of the present invention includes a threaded portion that receives a threaded end of the carrier 22. For example, the hub 18 may be comprised of internally threaded fastener that is pressed into the surrounding metal, e.g., a PEM® Nut manufactured by Penn Engineering and Manufacturing Corp. Alternatively, the required threads may be directly machined into the plate 6 or the carrier 22 may be permanently integrated onto the plate. Still further, the carrier 22 may be interconnected to the hub 18 by a nut that is received onto a portion of the carrier 22 that extends through the plate. The plate 6 is preferably circular and has an outer edge 30 that corresponds with an outer edge 34 of a flange 38 associated with the wastewater strainer 42 engaged to a bottom surface 46 of the bathtub 50. The opening 10 may be a series of openings similar to a grate. Further, the opening 10 or openings may be of any shape, such as that associated with a logo. In one embodiment of the present invention, the plate 6 is about 1/32 inch thick, has an outer diameter of about 3 inches, and has an opening having a diameter of about 1 7/16 inches.

The plate 6 of the concealing device 2 may include a downwardly extending lip 54 or a plurality of members, e.g., tabs, that engage the outer edge 34 of the strainer flange 38 to ensure that the drain opening 62 is unobstructed, as it is desirable to maintain the opening 10 of the concealing device 2 with respect to the opening 62 provided by the wastewater strainer 42.

The plate 6 of one embodiment of the invention is adapted to receive logos and laminates and be any color. The plate 6 is preferably made of a metallic material, but other materials, such as plastic may be employed. Further, temperature sensitive materials that provide a visual indication of water temperature may be employed, which is important when bathing children. The plate 6 may include temperature sensitive portions in the form of letters or logos as well.

In operation, the flange 38 of the wastewater strainer 42 and/or the underside of the plate 6 is applied with adhesive 64 or an adhesive tape. The plate 6 is then affixed to the flange 38 wherein the opening 10 of the plate is generally aligned with the opening 62 of the wastewater strainer. The stopper 26 is then associated with the carrier 22. As one of skill in the art will appreciate, the plate 6 may be interconnected to the wastewater strainer 42 without an adhesive wherein the hub 18 of the plate 6 is interconnected to the hub of the wastewater strainer 42 (not shown) by way of a connecting member, e.g., a threaded rod. The connecting member may also be integral with the carrier 22. Further, the connecting member may be capable of interconnecting to wastewater strainers of various sizes and manufacture.

Figure 6:
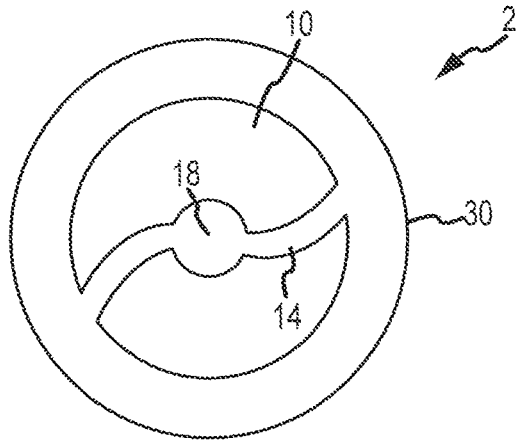
FIG. 6 is a top plan view of another embodiment of the present invention.
Figure 7:
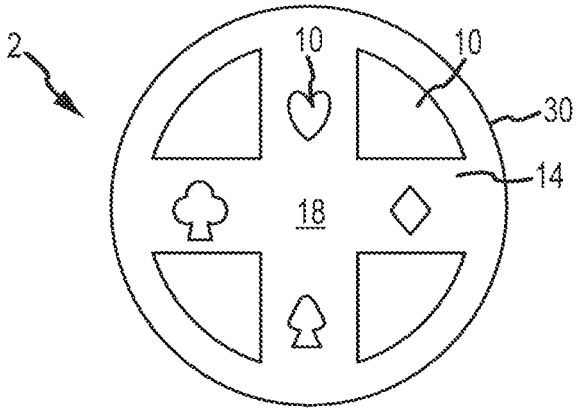
FIG. 7 is a top plan view of another embodiment of the present invention.
Figure 8:
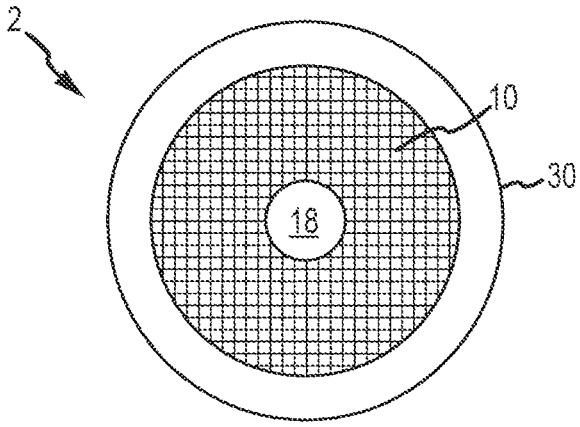
FIG. 8 is a top plan view of another embodiment of the present invention.
Figure 9:
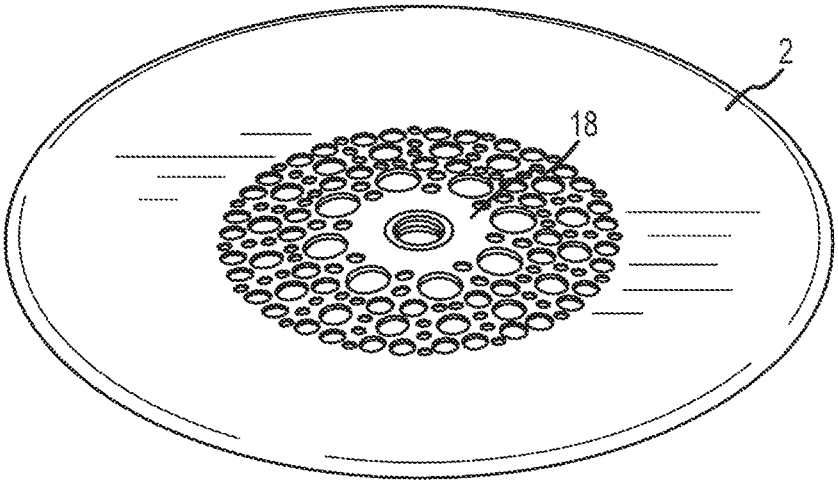
FIG. 9 is a top perspective view of another embodiment of the present invention similar to FIG. 8.
Figure 10:
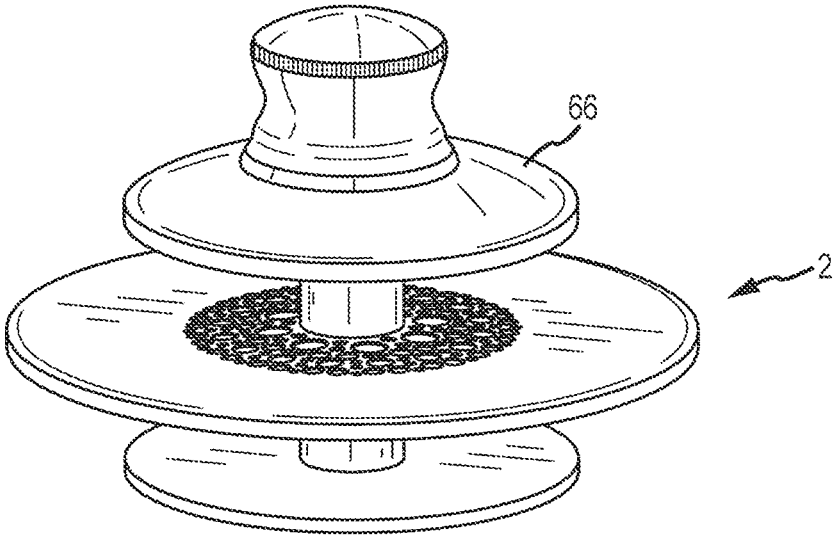
FIG. 10 is a front perspective of the embodiment shown in FIG. 9 shown in conjunction with a stopper.

Referring now to FIGS. 3-10, plates 6 of various styles are provided. As will be appreciated by those in the art, the plate 6 may include openings 10 of various sizes and configurations. Similarly, the arms 14 of any number may be employed. For example, in FIG. 3, three arms 14 are provided while in FIG. 4, four arms 14 are provided. The arms may be symmetrical or may be non-symmetrical, as shown in FIG. 6. Furthermore, the arms may include designs or openings of various shapes as contemplated by FIG. 7. Those skilled in the art will appreciate that the opening may be comprised of a grate as shown in FIGS. 8-10 wherein the hub 18 is positioned thereon.

Those skilled in the art will also appreciate that the outer edge 30 and edges associated with the openings 10 may be beveled to create a sloped interface between the top surface of the plate 6 and the bottom of the bathtub floor. The outer diameter of the outer edge 30 may be smaller, but is preferably equal to or larger than the diameter of the existing wastewater strainer flange to which it will be interconnected. Those skilled in the art will appreciate that larger diameters may be needed in order to fully conceal the drain port of a bathtub and associated strainer. The plate 6 may have various finishes as described herein. Furthermore, the arms 14 and/or hub 18 may have finishes that are different from the other portions of the plate 6.

Figure 11:
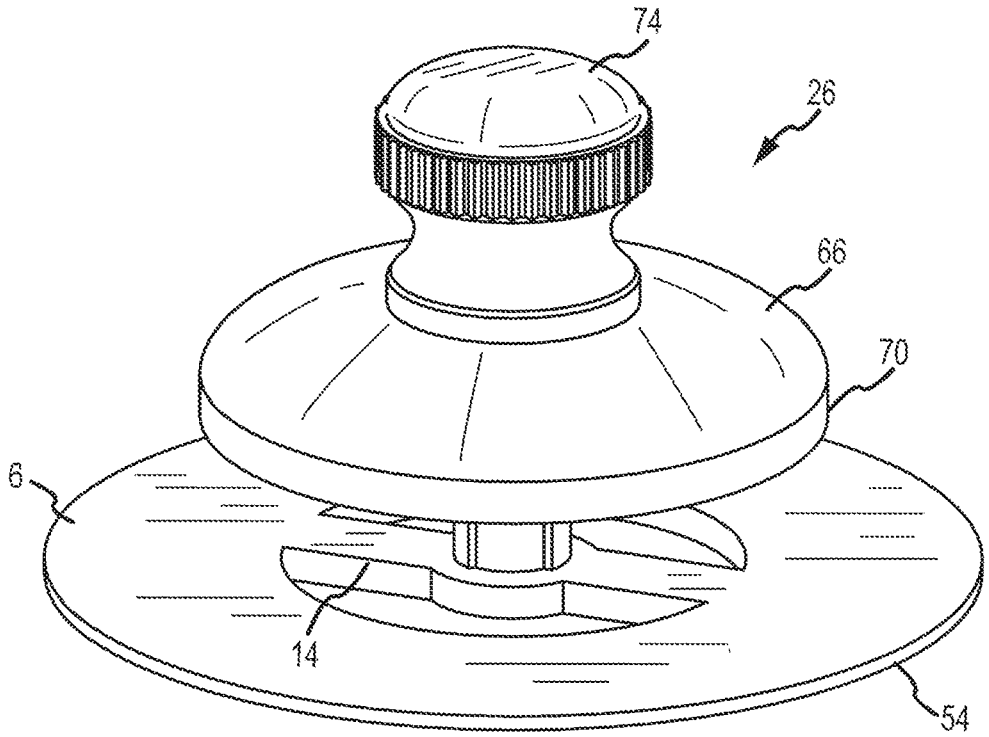
FIG. 11 is a perspective view of FIG. 2 with an associated stopper.
Figure 12:
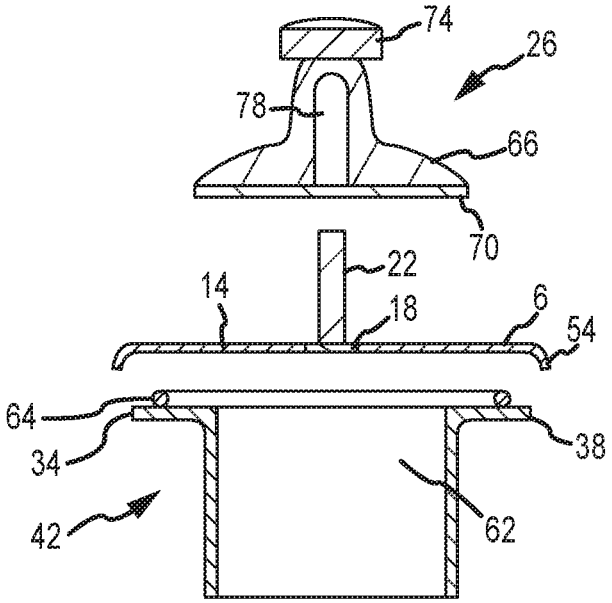
FIG. 12 is a cross-sectional view of FIG. 11 positioned adjacent to a wastewater strainer.

FIGS. 11 and 12 show the carrier 22 that is adapted to receive the stopper 26. Stoppers 26 are commonly comprised of a stopper body 66 with interconnected gasket 70 that cooperates with the plate 6 to prevent fluid flow through the opening 10 in the plate and the opening 62 in the strainer flange. The stopper 26 may include a knob 74 and includes a cavity 78 for receipt of the carrier 22 such that no portion of the stopper 26 or concealing device 2 penetrates into the strainer 42. As discussed above, the stopper 26 may be lift and turn, Presflo™, push/pull, foot-actuated, solenoid actuated, or any other type of stoppers commonly employed. The stopper and associated knob may include a feature that prevents the stopper from completely separating from the carrier. Such feature is found, for example, in U.S. Pat. No. 5,758,368.

Figure 13:
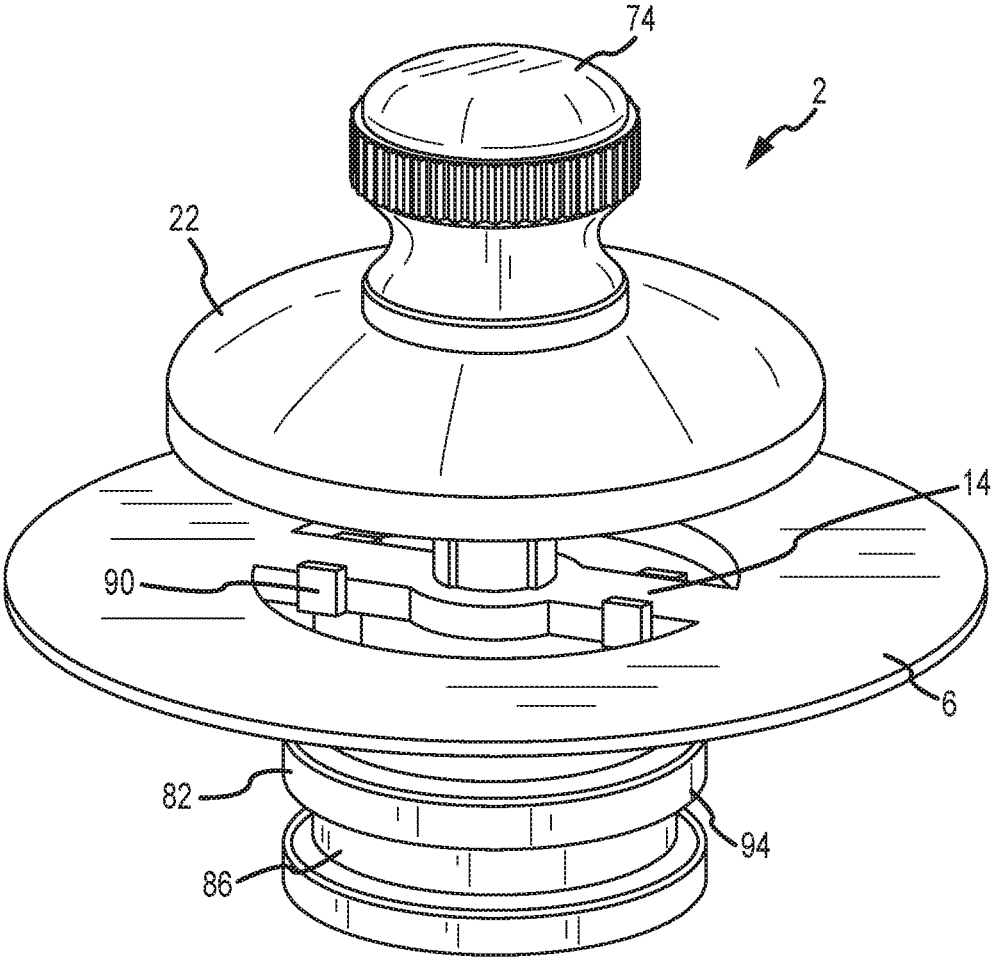
FIG. 13 is a front elevation view of a waste water concealing device of another embodiment of the present invention that employs an adapter for insertion into the wastewater strainer.

Referring now to FIG. 13, another embodiment of the present invention is shown that includes an adapter 82 that is associated with the plate 6. The adapter 82 is a cylindrical portion that includes at least one seal groove 86 for receiving an o-ring (not shown). In operation, the o-ring, plugs, a fitted seal, etc., engages the adapter to an inner wall of the strainer body to secure the concealing device 2. Thus, one of skill in the art will appreciate that this embodiment of the present invention does not necessarily require the use of adhesive between the plate 6 and the flange of the wastewater strainer. It is, however, advisable to use such adhesive to prevent fluid infiltration between the adapter 82 and the wastewater strainer. In one embodiment of the present invention, the adapter is held to the arms 14 of the concealing device by a clip 90. The adapter can be of any size and may be selectively removable if an end user does not wish to use the same. The adapter 82 does not require a seal groove and a cylindrical wall may be used to assist aligning the concealing device 2 over the strainer body. The adapter 82 includes a conduit 94 to allow fluid to flow therethrough.

One of skill in the art will appreciate that the adapter may be integral with the plate 6. For example, a frangible adapter may be associated with the plate 6 that is designed to protrude into the strainer body and that includes weakened areas to allow the adapter to be selectively shortened or completely removed. Similarly, a telescoping adapter may be provided that has the ability to be selectively increased or decreased in length to accommodate various strainer bodies. Further, at least one downwardly-extending tab may be associated with the plate 6. The tabs extend into the strainer body in such away to avoid the hub and spokes associated with the strainer body. The tabs may be frangible or hooks may be employed similar to those taught by U.S. Pat. No. 5,692,248.

Figure 14:
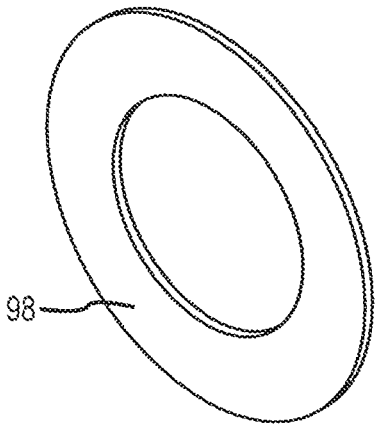
FIG. 14 is a perspective view of an adhesive tape used to secure the concealing device of one embodiment of the present invention to the wastewater strainer.
Figure 15:
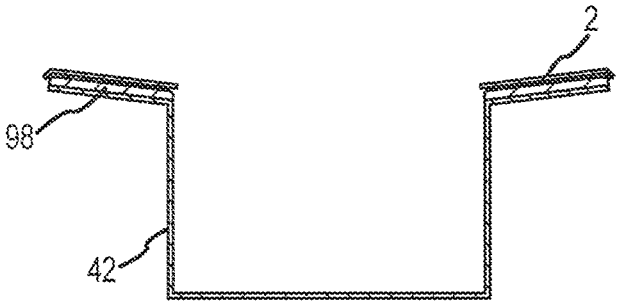
FIG. 15 is a cross sectional view showing a concealing device interconnected to a wastewater strainer.

FIGS. 14 and 15 show an embodiment of the present invention where double-sided tape 98 is employed to interconnect the concealing device 2 to the wastewater strainer 42. More specifically, as outlined above, the concealing device is often fixed to the strainer with an adhesive or sealant. Some silicone sealants, however, are not easy to remove after they cure. To address this issue, two-sided pressure sensitive acrylic closed cell foam tape is used to bond the concealing device 2 to the wastewater strainer 42. An example of such tape is manufactured by 3M™ and is sold as VHB™ Acrylic Foam Tape, which is resistant to cleaning chemicals, forms a permanent seal, is virtually invisible, and is conforming.

Figure 16:
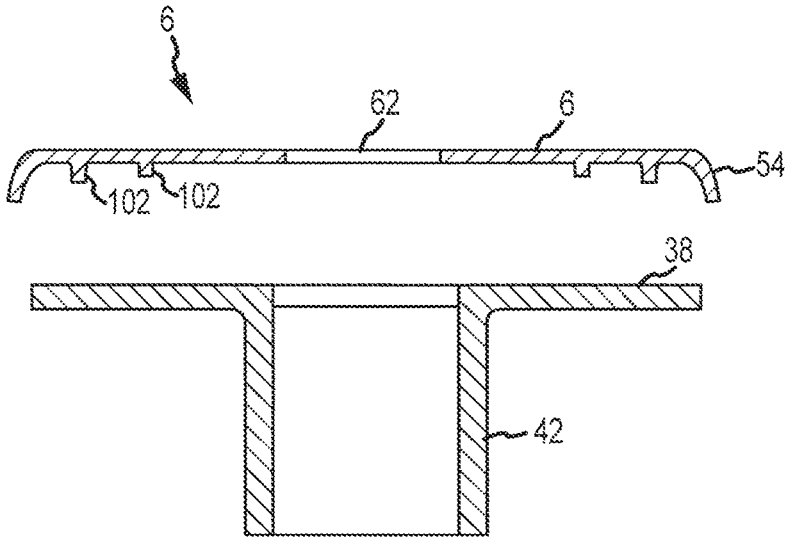
FIG. 16 shows a plate having a plurality of concentric alignment rings.

FIG. 16 shows an alternative embodiment of a plate 6 that includes a plurality of concentrically aligned rings 102. The rings 102 are designed to help align the plate 6 onto the strainer flange 38. More specifically, in most instances, the lip 54 of the plate 6 will contact the outer edge of the flange 38 to align the plate 6. However, in instances where the flange 38 has a diameter smaller than that of the plate 6, an interior ring 102 will contact the outer edge of the flange 33. As shown, the rings 102 are increased in length radially outwardly from the plate opening 62. As such, an inner ring will not interfere with the function of the outermost rings when the plate is engaged onto a small strainer flange. The spaces between each ring will receive adhesive and facilitate the bond between the plate 6 the strainer flange 38.

Figure 17:
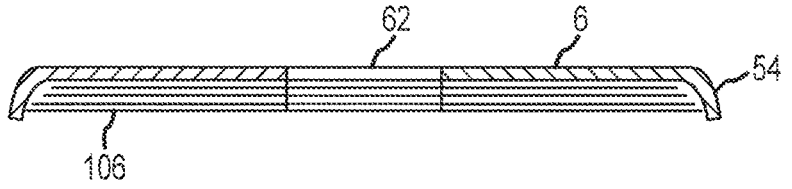
FIG. 17 is a plate of one embodiment that employs a plurality of adhesive sheets.

FIG. 17 shows a plate 6 having a plurality of adhesive sheets 106 associated with its underside. It is contemplated that this plate 6 will be more apt to accommodate strainer flanges of varying thicknesses. In operation, removal of multiple sheets and associated substrates will increase the recess provided by the lip 54 as the deeper the recess, the thicker the strainer flange that can be accommodated. Once the desired recess is achieved, no further adhesive sheets would be removed. In order to maintain the remaining adhesive sheets and associated plate to the flange, the adhesive may be heat activated such that when exposed to hot water, it cures and hardens to prevent removal.

Figure 2:
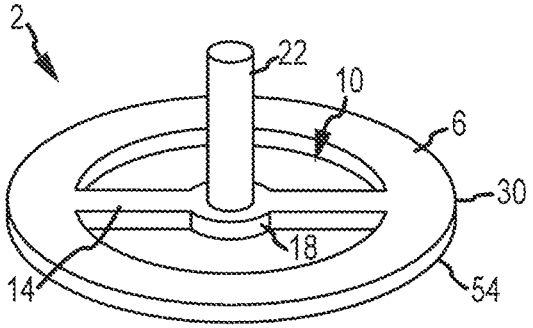
FIG. 2 is a perspective view of one embodiment of the present invention.
Figure 3:
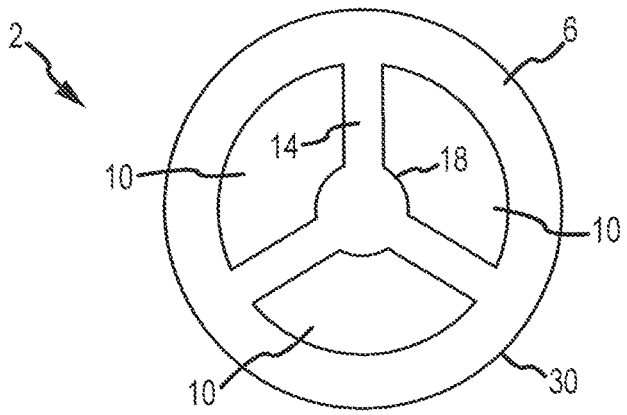
FIG. 3 is a top plan view of another embodiment of the present invention.
Figure 4:
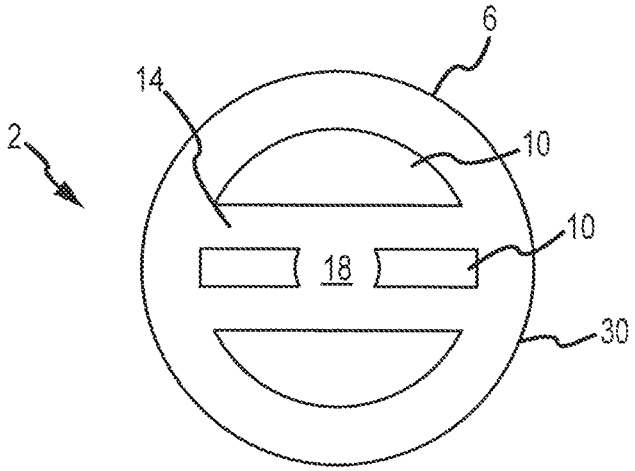
FIG. 4 is a top plan view of another embodiment of the present invention.
Figure 5:
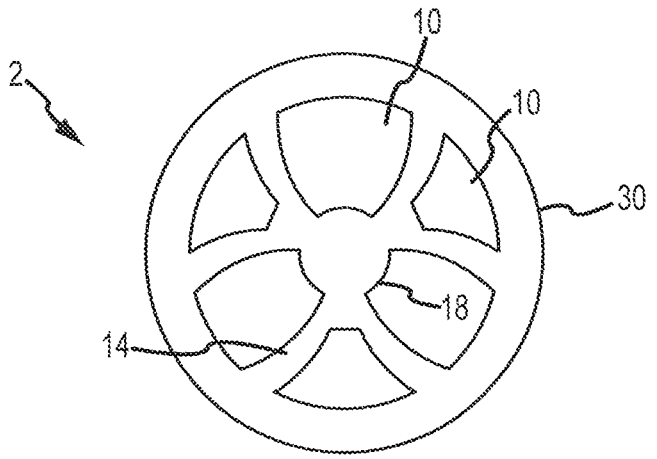
FIG. 5 is a top plan view of another embodiment of the present invention.
Figure 18:
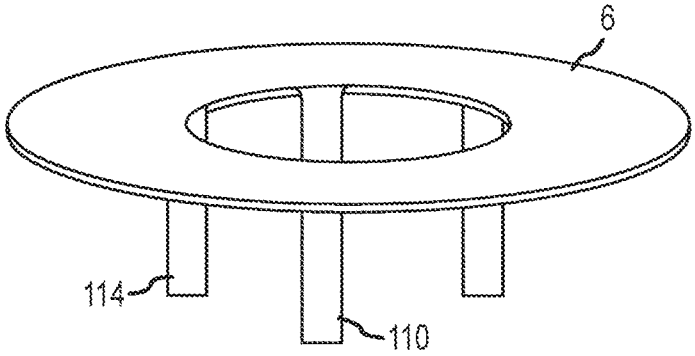
FIG. 18 is a plate having a plurality of removable tabs.

FIG. 18 shows yet another way to align the plate 6 of one embodiment of the present invention. This plate has a plurality of tabs 110 that are designed to fit within the strainer. That is, the tabs 110 are spaced such that the crossed members of the strainer body, or spokes 194 (see FIG. 41) are accommodated between the tabs. The tabs 110 may also be frangible a weakened area such as score lines 114 to decrease their height and width. In one embodiment of the present invention, the tabs 110 are completely removable to yield a plate as shown in FIG. 2, for example. The tabs 110 may be flexible and splayed outwardly or bowed to be flexed inwardly to engage the inner surface of the strainer body to enhance engagement between the plate 6 and the strainer.

Figure 19:
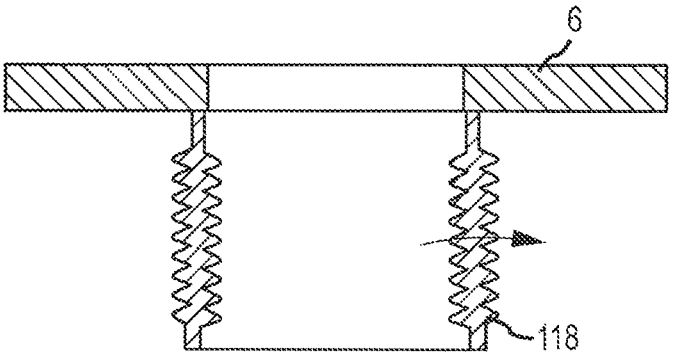
FIG. 19 is a plate having aligning bellows.
Figure 20:
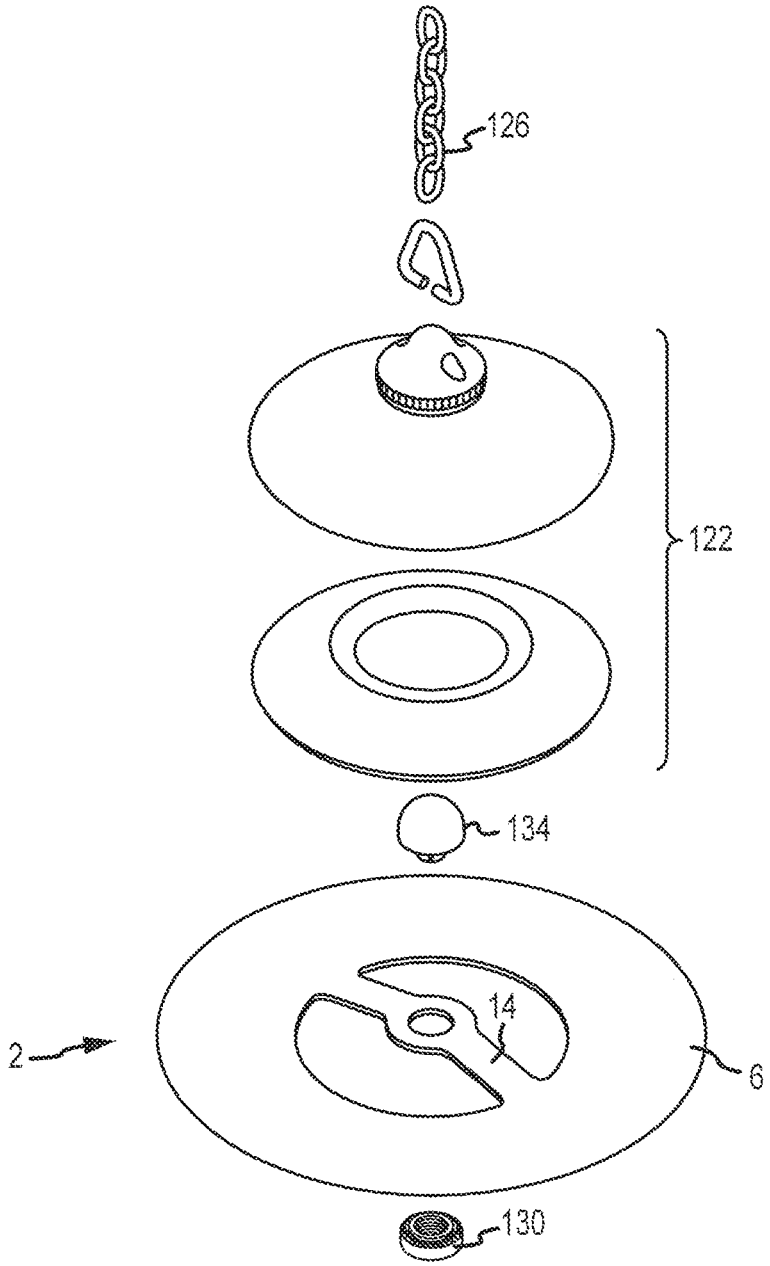
FIG. 20 is an exploded perspective view of a chain and stopper that is used in connection with a concealing device of one embodiment.
Figure 21:
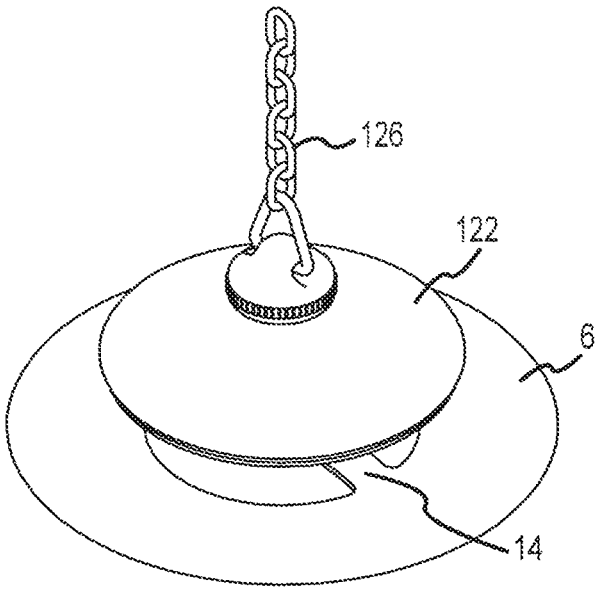
FIG. 21 is a perspective view of a chain and stopper of FIG. 20 shown in an open configuration.
Figure 22:
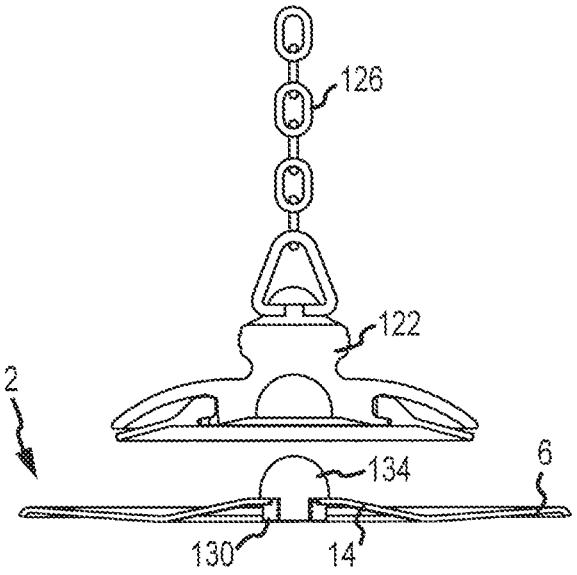
FIG. 22 is a cross-sectional view of FIG. 21.
Figure 23:
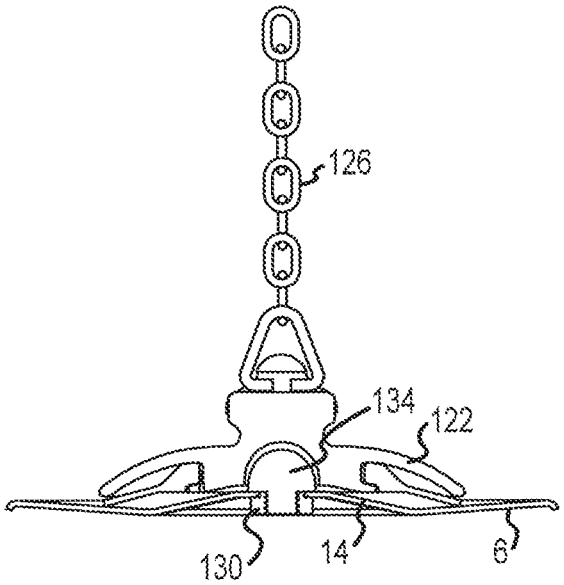
FIG. 23 is a cross-sectional view of FIG. 21 shown in a closed configuration.
Figure 24:
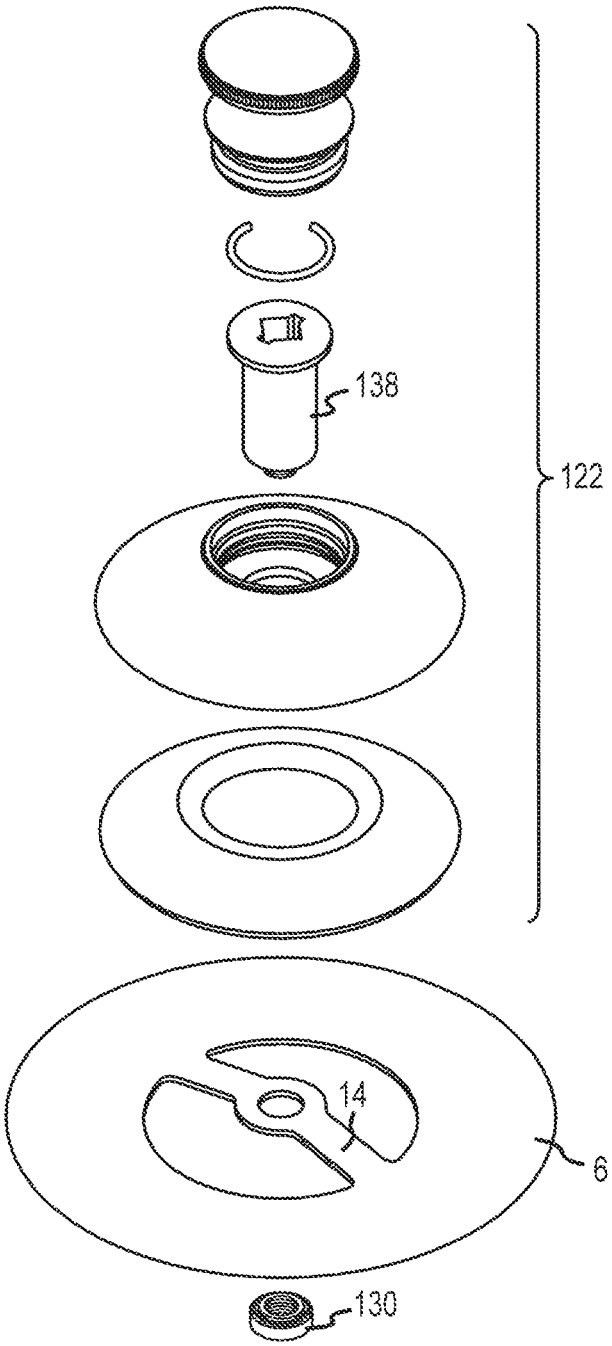
FIG. 24 is an exploded perspective view of a push/pull stopper that is used in connection with a concealing device of one embodiment.
Figure 25:
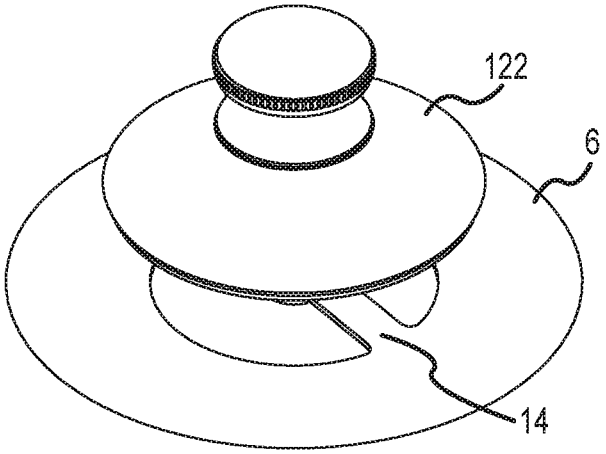
FIG. 25 is a perspective view of the push/pull stopper of FIG. 24 shown in an open configuration.
Figure 26:
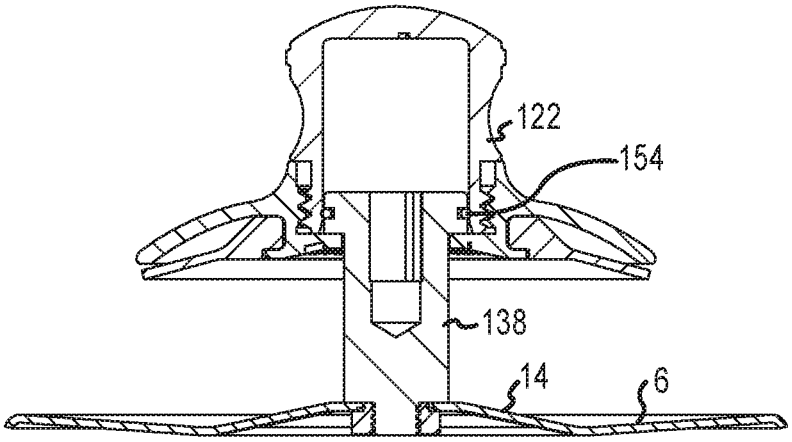
FIG. 26 is a cross-sectional view of FIG. 24.
Figure 27:
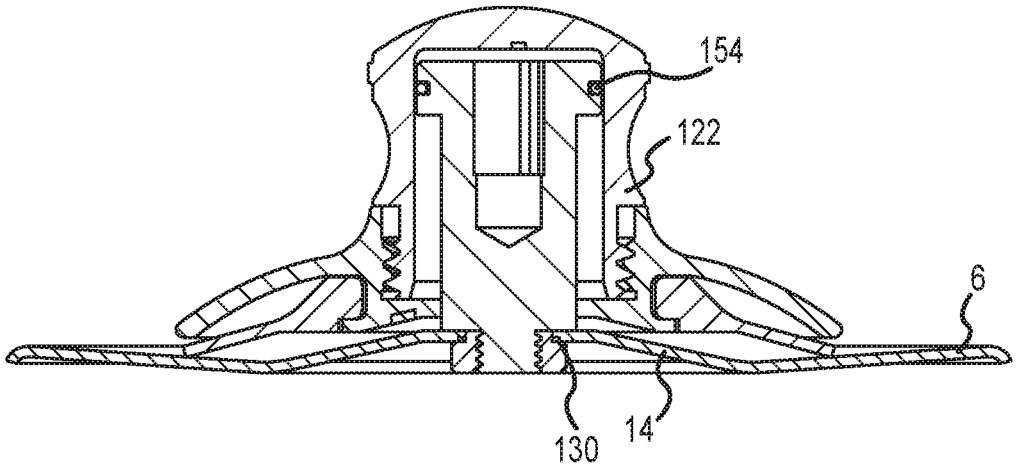
FIG. 27 is a cross-sectional view of FIG. 24 shown in a closed configuration.
Figure 28:
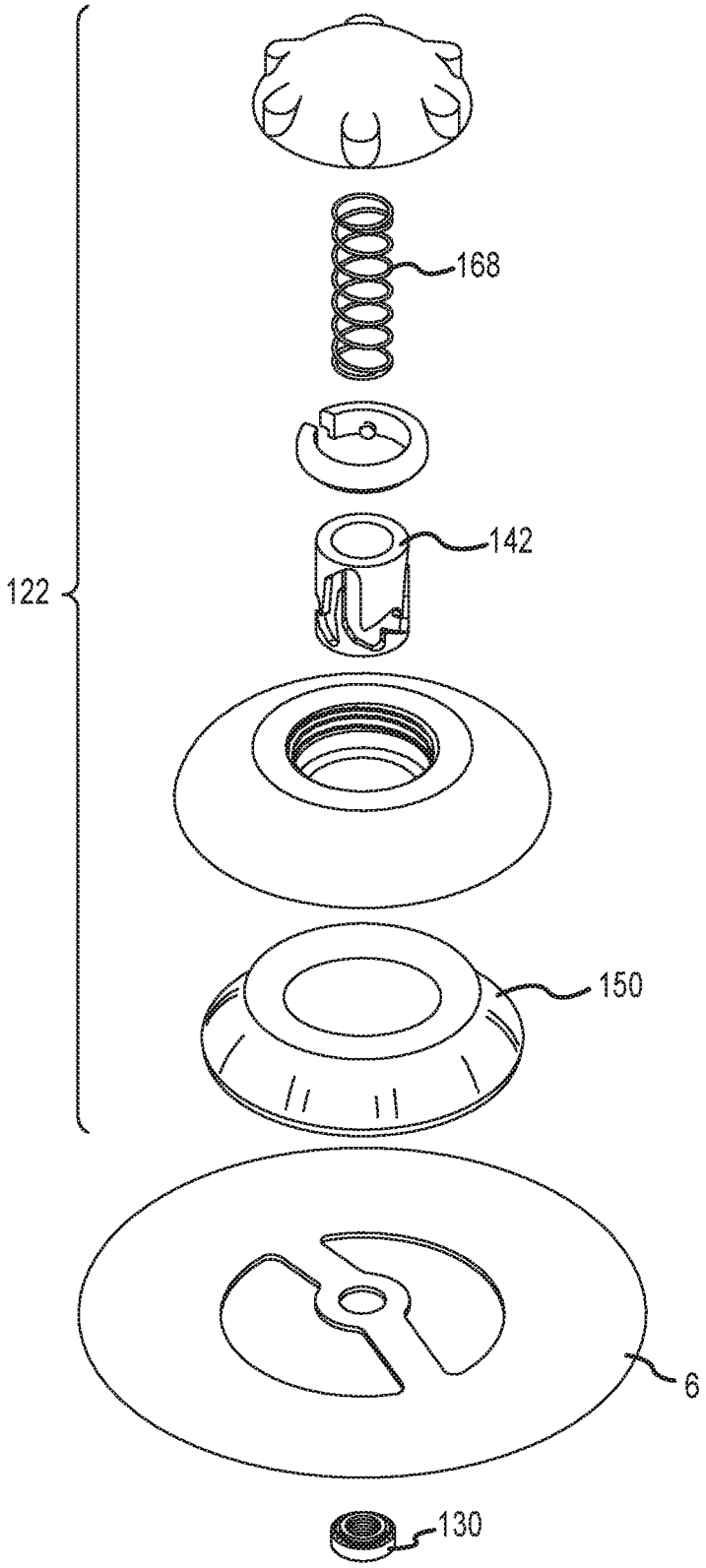
FIG. 28 is an exploded perspective view of a foot-actuated stopper that is used in connection with a concealing device of one embodiment.
Figure 29:
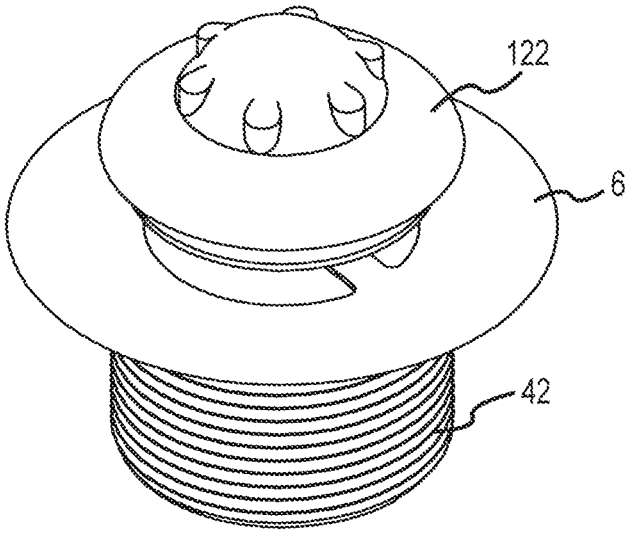
FIG. 29 is a perspective view of a foot-actuated stopper shown in an open configuration.

FIG. 19 shows an alternate embodiment of a plate having a bellows portion 118 extending therefrom that helps align the plate 6 onto the strainer body. The bellows portion 118 will compress when it contacts the cross members of the strainer body, thereby allowing the plate to be used on various types of strainer bodies. Once skilled in the art will appreciate that the bellows portion may be made with a plurality of openings to allow fluid flow therethrough. The bellows section may also be made of thin material such that it can be cut to a desired length or removal from the plate.

FIGS. 20-23 show a stopper 122 and chain 126 used in conjunction with a concealing device 2 of one embodiment of the present invention. As discussed above, the plate 6 of embodiments of the present invention can accommodate stoppers of various configurations. Here, the plate includes arms 14 that are slightly raised that receive a PEM insert 130. One of skill in the art will appreciate that the plate may be devoid of arms wherein the stopper rests in the opening in the plate. The PEM insert 130 receives a centering dome 134 that helps align the stopper 122 on the plate 6. As can be appreciated upon review of FIG. 23, for example, no part of the stopper 112 is positioned in the strainer body when the drain is closed. Thus, the stopper is universal and can be used in conjunction with embodiments of the present invention to accommodate any strainer body.

Referring now to FIGS. 24-27, a push/pull stopper 122 used in conjunction with embodiments of the present invention is shown. As described above, a PEM insert 130 is incorporated into the plate 6. The PEM insert 130 receives a carrier 138 that is associated with the stopper. Again, no part of the stopper 122 extends below the plate 6. A friction ring 154 is used to maintain the stopper in an open or closed configuration.

FIGS. 28-31 show a foot-actuated stopper 122 that may also be incorporated with embodiments of the present invention. Here, a guide member 142 is associated with a stopper body 146 via a ring follower 158. When a cap 164 is actuated by a user's foot or hand, the stopper body 146 will move the ring follower 158 in a guide path 144 which will rotate the guide member 142. Eventually the seal 150 will contact the plate 6 to prevent fluid flow through the strainer body. At that point, pressure on the cap 164 is released and the guide path prevents upward movement of the ring follower 158 because the detents 143 thereof are abutted against a wall of the guide path 144. That is, the interaction of the ring follower 150 with the guide path 144 will prevent separation of the seal 150 from the plate 6. The cap 164 is further depressed to open the stopper.

More specifically, forcing the ring follower 158 downwardly rotates the guide member 142 to eventually provide an obstruction-free guide path that will allow the ring follower 158 and interconnected cap to move upwardly. The cap 164 is urged upwardly by a spring 168.

Figure 30:
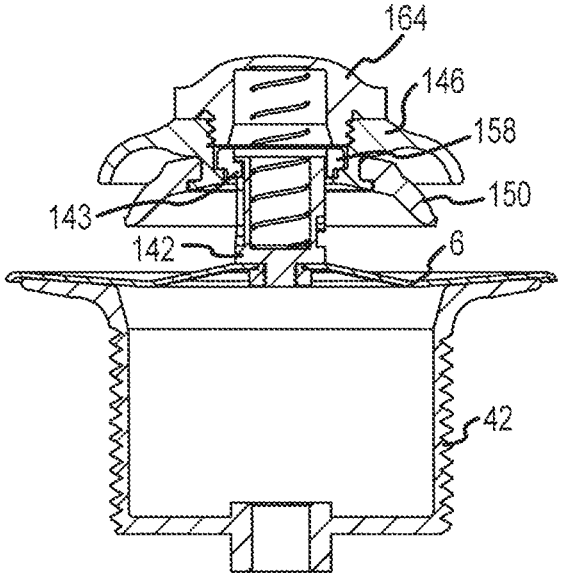
FIG. 30 is a cross-sectional view of FIG. 28.
Figure 31:
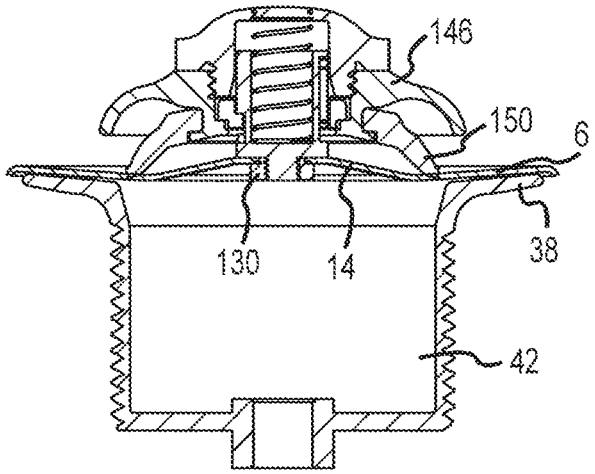
FIG. 31 is a cross-sectional view of FIG. 28 in a closed configuration.
Figure 32:
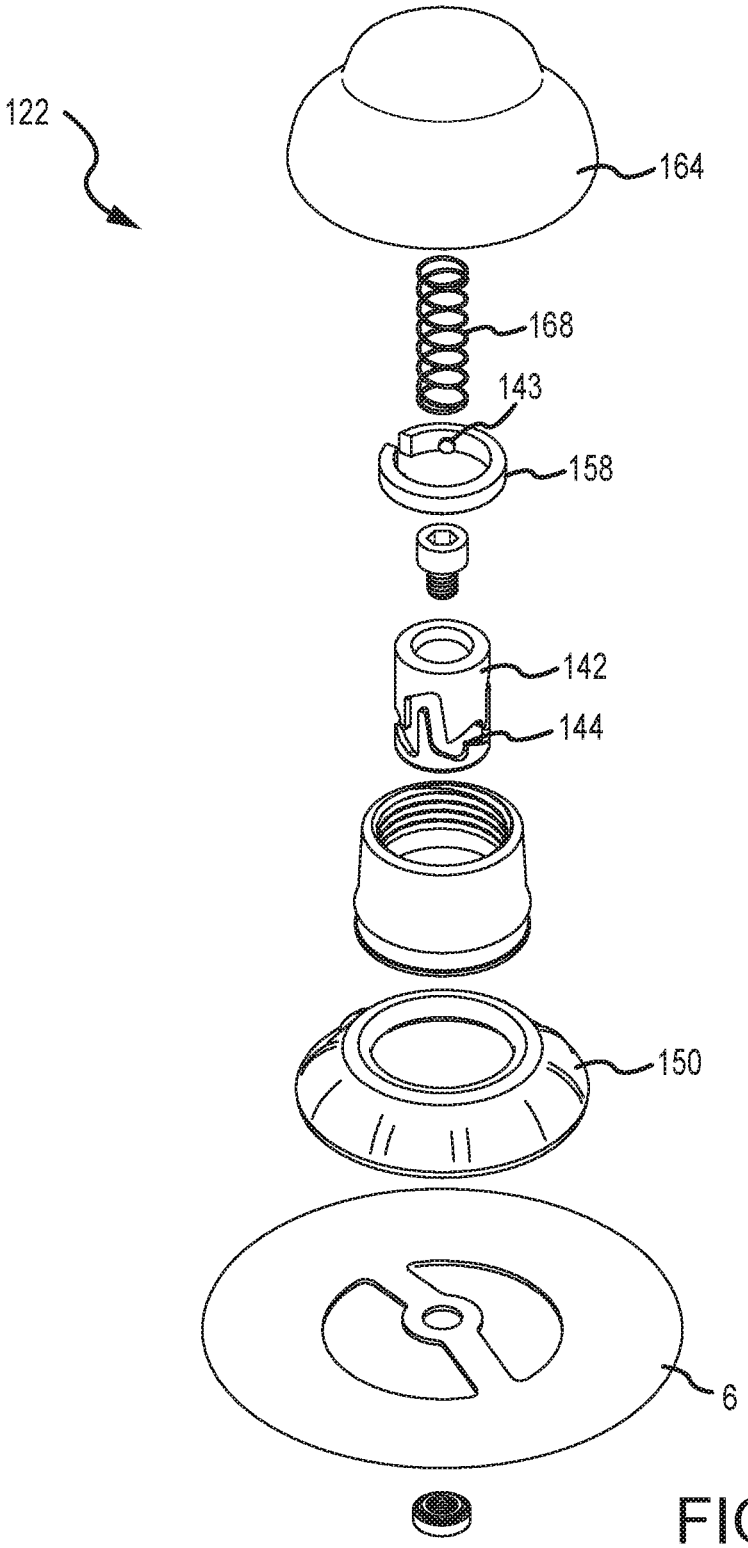
FIG. 32 is an exploded perspective view of a foot-actuated stopper that is used in connection with a concealing device of one embodiment.
Figure 33:
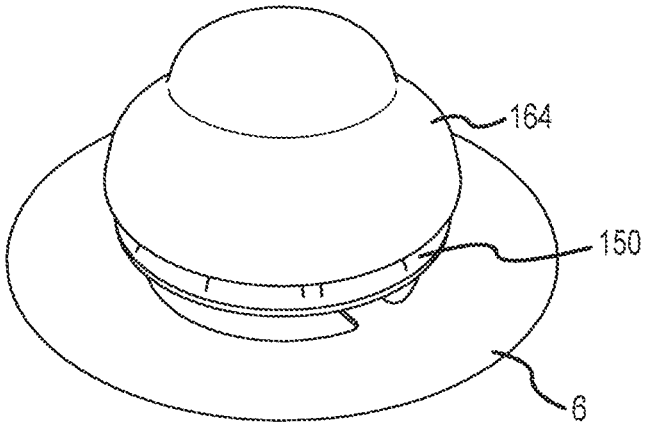
FIG. 33 is a perspective view of the foot-actuated stopper shown in an open configuration.
Figure 34:
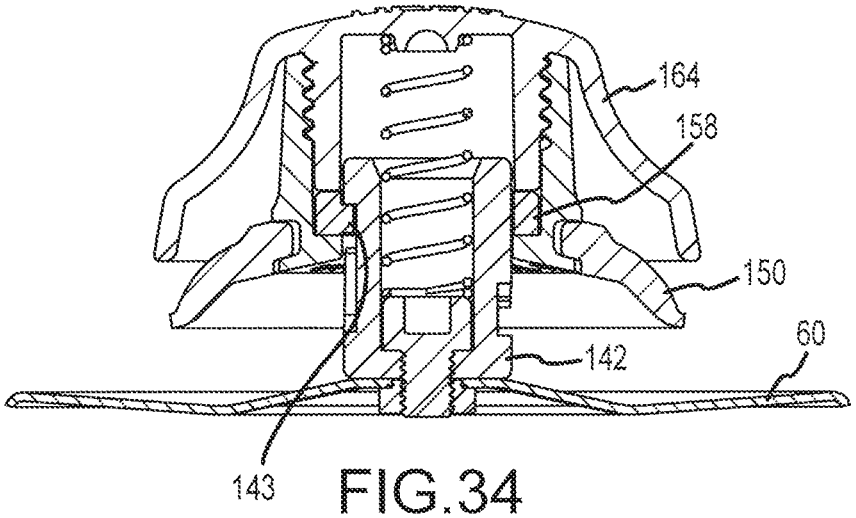
FIG. 34 is a cross-sectional view of FIG. 32 shown in an open configuration.
Figure 35:
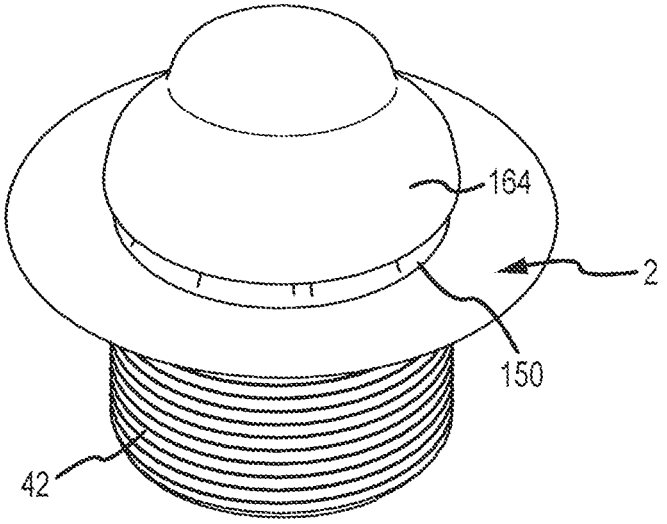
FIG. 35 is a foot-actuated drain stopper of one embodiment of the present invention that is selectively interconnected to a traditional strainer body.
Figure 36:
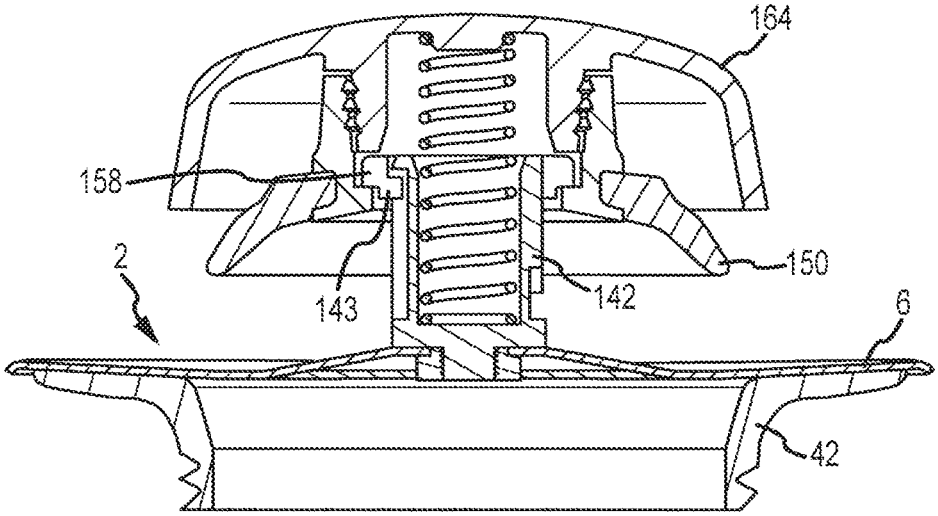
FIG. 36 is a cross sectional view of the system shown in FIG. 35 shown in an open configuration.
Figure 37:
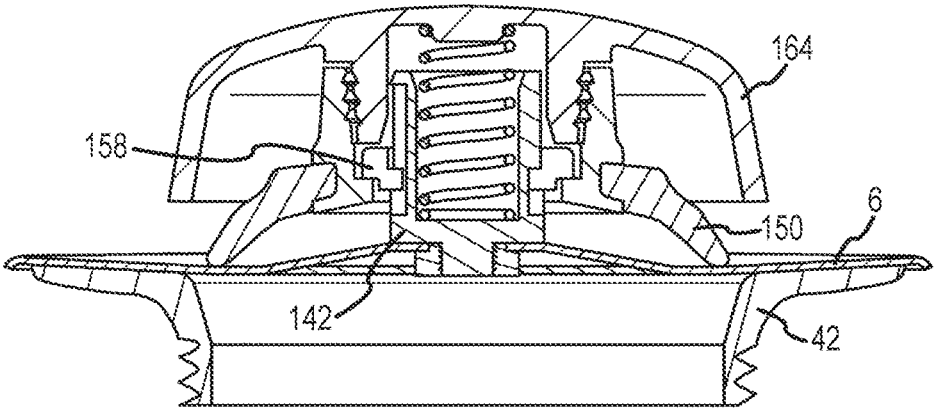
FIG. 37 is a cross-sectional view of the system shown in FIG. 35 shown in a closed configuration.
Figure 38:
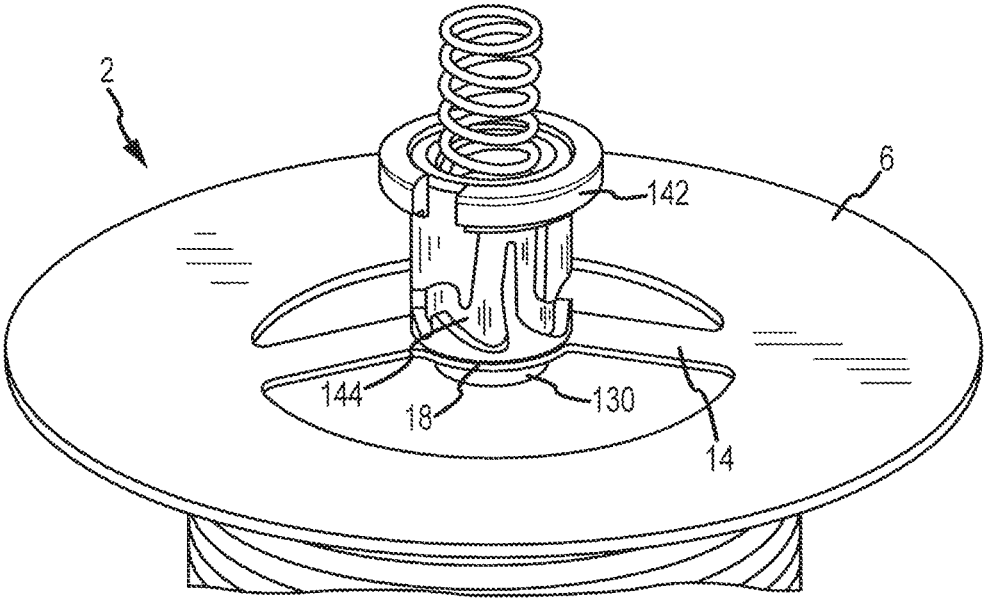
FIG. 38 is a perspective view of the system of FIG. 35 wherein the drain stopper has been removed for clarity.

FIG. 30 shows the wastewater strainer 42 wherein the plate 6 is positioned on the flange 38 thereof. Again, no portion of the plate 6 or stopper 122 substantially protrudes into the wastewater strainer 42, thereby making this combination and other stopper and plate combinations universal.

Referring now to FIGS. 32-38, another embodiment of the present invention is shown that is similar to that shown in FIGS. 28-31. More specifically, a cap 164 is interconnected to the guide member 142 having a guide path 144 that operatively receives a ring follower 158. The ring follower 158 rotates the guide path 142 as the cap is pressed towards the plate 6. In this way, the cap and associated rubber seal 150 are brought in contact with the plate 6 or removed therefrom. The spring 168 of this embodiment of the present invention rests against a screw that is interconnected to a PEM fastener. The spring and guide member 142 are thus able to rotate relative to the fixed screw when the cap is moved toward and away from the plate.

Figure 39:
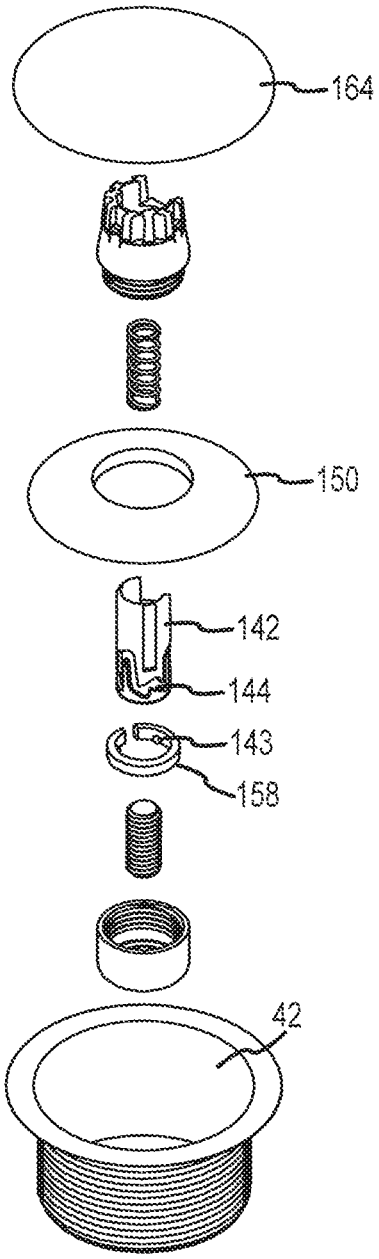
FIG. 39 is an exploded perspective view of a foot-actuated drain stopper of another embodiment of the present invention that is selectively interconnected to a traditional strainer body.

FIG. 39 shows another embodiment of the present invention that is not necessarily associated with a low profile plate as shown and described above. More specifically, this embodiment of the present invention is more aptly associated with a strainer body of the prior art. Again, a guide path is provided that is interconnected via a said screw to a stringer of the strainer body. The ring follower is also operably associated with the guide path and thus functions similar to that shown above with respect to FIGS. 33-39.

Figure 40:
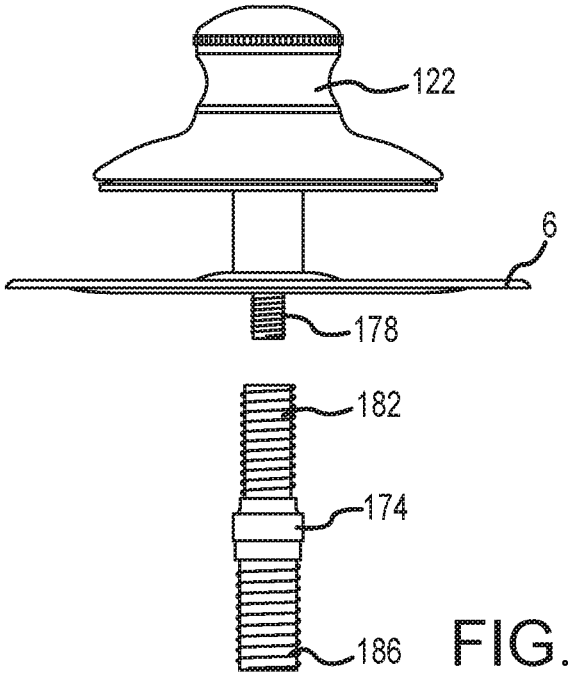
FIG. 40 is a front elevation view of one embodiment of the present invention that is interconnected to the waste water strainer by way of a connector.
Figure 41:
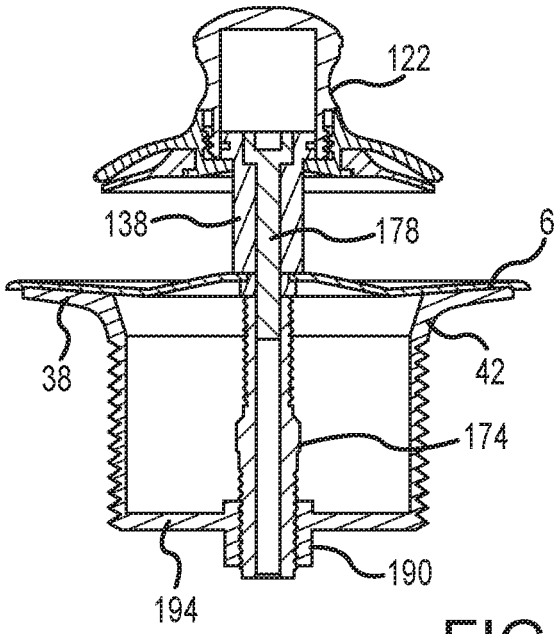
FIG. 41 is a cross section of FIG. 40.

FIGS. 40 and 41 show a concealing device of one embodiment of the present invention interconnected to a strainer body 42. More specifically, a connector 174 is provided having a first end 182 and a second end 186. Both ends may be internally threaded to receive a bolt 178 that is associated with the plate 6 that conceals the flange 38 of the strainer body 42. The bolt extends through the concealing device and threads into either the internal diameter of the first end 182 or the internal diameter of the second end 186. The first end 182 and the second end 186 also include external threads for receipt within a hub 190 that is interconnected by a plurality of spokes 194 to the cylindrical portion of the strainer body 42. The internal diameter of the hub 190 will dictate which side of the connector 174 is threaded into the hub 190 and which side receives the bolt 178. In this fashion, the plate 6 is firmly engaged against the flange 38 and conceals the same.

In operation of the device as shown in FIGS. 32-41, one would press down on the cap, which would force the ring follower to travel along the guide path. As the protrusions of the ring follower travel along the guide path, the member rotates to allow the ring follower to travel the length of the member. In this way, the descent of the cap is controlled. After the cap or stopper top is placed adjacent to the plate or the flange of the strainer body, the ring follower will be positioned at a lower portion of the guide path. To disengage the cap from the steel plate or the strainer body, additional downward force is initially added to the cap, thereby rotating the guide path in such a way to expose the upper part of the path, which allows the ring follower to travel upwardly and disassociate the rubber seal from the steel plate.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the claims provided herewith. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Furthermore, one of skill in the art will appreciate that the invention described herein may be used with or incorporated into any of the inventions in the patents and applications listed: U.S. Pat. No. 5,692,248, entitled "Method and Means for Covering the Flange of a Wastewater Strainer"; U.S. Pat. No. 5,745,931, entitled "Method and Means for Covering the Flange of a Wastewater Strainer"; U.S. Pat. No. 7,503,083, entitled "Method and Means for Covering the Flange of Wastewater Strainer"; U.S. Pat. No. 5,890,241, entitled "Method and Means for Installing Overflow Outlets to Bathtubs and the Like", U.S. Pat. No. 6,066,119, entitled "Wastewater Strainer and Valve"; U.S. Pat. No. 6,148,454, entitled "A Solenoid Control for a Bathtub Wastewater Drain"; U.S. Pat. No. 6,154,898, entitled "Wastewater Drain Control for Fluid Compartments"; U.S. Pat. No. 6,173,459, entitled "A Control For a Bathtub Wastewater Drain"; U.S. Pat. No. 6,226,806, entitled "Wastewater Strainer and the Like"; U.S. Pat. No. 6,317,906, entitled "Strainer Assembly for Bathtub Drains and the Like": U.S. Pat. No. 6,418,570, entitled "Drain Closure"; U.S. Pat. No. 6,546,573, entitled "Drain Cover Assembly"; U.S. Pat. No. 6,631,623, entitled "Condensate Drain Attachments and Method of Use Thereof"; U.S. Pat. No. 6,637,050, entitled "Overflow Assembly for Bathtubs and the Like"; U.S. Pat. No. 6,640,358, entitled "Strainer Assembly for Bathtub Drains and the Like"; U.S. Pat. No. 6,675,406, entitled "Overflow Assembly for Bathtubs and the Like"; U.S. Pat. No. 6,675,407, entitled "Solenoid Activated Bathtub Drain Closure"; U.S. Pat. No. 6,681,420, entitled "Method and Apparatus for Installing a Bathtub Assembly"; U.S. Pat. No. 6,691,411, entitled "Method of Installing a Wastewater Drain Assembly for a Bathtub"; U.S. Pat. No. 7,127,752, entitled "Overflow Assembly for Bathtubs and The Like"; U.S. Pat. No. 7,451,502, entitled "Bath Drain Closure Assembly"; and U.S. Pat. No. 7,503,083, entitled "Means for Covering the Flange of a Wastewater Strainer"; U.S. Patent Application Publication Nos. 20040117907, entitled "Method and Apparatus for Assembling and Sealing Bathtub Overflow and Wastewater Ports"; 20080047060, entitled "Control for a Bathtub Wastewater Drain"; 20070039098, entitled "Bath Drain Closure Assembly"; 20080098517, entitled "Method and Associated Apparatus for Assembling and Testing a Plumbing System"; and 20080196161 entitled "Flexible Bathtub Waste Pipe Assembly for Bathtubs and the Like"; and 20090172877, entitled "Method and Means for Covering the Flange of a Wastewater Strainer"; and 20100037392 entitled "Cable Actuated Drain"; all of which are incorporated by reference in their entirety herein.

What is claimed is:

1. A concealing device for a wastewater strainer, the concealing device comprising:

a plate defining an opening therethrough, wherein the plate is configured to conceal a flange of the wastewater strainer;

a hub disposed within the opening and coupled to the plate; and a connector comprising a first end and an opposite second end, wherein the first end is configured to couple to the hub of the plate and the second end is configured to couple to a hub of the wastewater strainer so that the plate is engaged with the flange of the wastewater strainer.

2. The concealing device of claim 1, further comprising a bolt coupled to the hub and extending therefrom.

3. The concealing device of claim 2, wherein the first end of the connector is configured to threadingly couple to the bolt.

4. The concealing device of claim 3, wherein the bolt threads into an internal diameter of the first end.

5. The concealing device of claim 2, further comprising a stopper configured to selectively prevent fluid flow through the opening coupled to the bolt.

6. The concealing device of claim 1, wherein the second end of the connector is configured to threadingly couple to the hub of the wastewater strainer.

7. The concealing device of claim 1, wherein the first end of the connector has a different external diameter than the second end of the connector.

8. The concealing device of claim 1, wherein the opening of the plate comprises a grate that supports the hub on the plate.

9. The concealing device of claim 1, further comprising at least one arm extending between the plate and the hub so as to support the hub within the opening.

10. The concealing device of claim 1, further comprising a carrier integral with the connector.

11. A concealing device for a wastewater strainer, the concealing device comprising:

a plate defining an opening therethrough, wherein the plate is configured to conceal a flange of the wastewater strainer;

a hub disposed within the opening and coupled to the plate;

a threaded bolt extending from the hub; and at least one threaded rod connector comprising a first end and an opposite second end, wherein the first end comprises an internal diameter with threads and the second end comprises an external diameter with threads, and wherein the first end is configured to threadingly couple to the threaded bolt and the second end is configured to threadingly couple to a hub of the wastewater strainer so that the plate is engaged with the flange of the wastewater strainer.

12. The concealing device of claim 11, wherein the second end of the at least one threaded rod connector comprises an internal diameter with threads so that the second end is configured to threadingly couple to the threaded bolt.

13. The concealing device of claim 11, wherein the first end of the at least one threaded rod connector comprises an external dimeter with threads.

14. The concealing device of claim 11, wherein the external diameter of the second end is different than an external diameter of the first end.

15. The concealing device of claim 11, further comprising a stopper configured to selectively prevent fluid flow through the opening coupled to the bolt.

16. A concealing device for a wastewater strainer, the concealing device comprising:

a plate defining an opening therethrough, wherein the plate is configured to conceal a flange of the wastewater strainer;

a hub disposed within the opening and coupled to the plate;

a connector comprising a first end and an opposite second end, wherein the first end is configured to couple to the hub of the plate and the second end is configured to couple to a hub of the wastewater strainer so that the plate is engaged with the flange of the wastewater strainer; and a stopper configured to selectively prevent fluid flow through the opening.

17. The concealing device of claim 16, further comprising a bolt coupled between the connector and the stopper.

18. The concealing device of claim 16, wherein the opening of the plate comprises a grate that supports the hub on the plate.

19. The concealing device of claim 16, further comprising at least one arm extending between the plate and the hub so as to support the hub within the opening.

20. The concealing device of claim 16, wherein the stopper comprises a push pull stopper.

* * * * *